US006019550A

United States Patent [19]

Wrigley et al.

[11] Patent Number: 6,019,550

[45] Date of Patent: Feb. 1, 2000

[54] MODULAR BLOCK RETAINING WALL CONSTRUCTION

[75] Inventors: Nigel Edwin Wrigley, Blackburn, United Kingdom; Michael John David Dobie, Jakarta, Indonesia

[73] Assignee: Nelton Limited, Blackburn, United Kingdom

[21] Appl. No.: 09/147,283

[22] PCT Filed: May 12, 1997

[86] PCT No.: PCT/GB97/01287

§ 371 Date: Feb. 3, 1999

§ 102(e) Date: Feb. 3, 1999

[87] PCT Pub. No.: WO97/44533

PCT Pub. Date: Nov. 27, 1997

[30] Foreign Application Priority Data

| | | | |
|---|---|---|---|
| May 21, 1996 | [GB] | United Kingdom | 9610598 |
| Aug. 28, 1996 | [GB] | United Kingdom | 9617938 |
| Feb. 14, 1997 | [GB] | United Kingdom | 9703213 |

[51] Int. Cl.[7] ..... E02D 29/00

[52] U.S. Cl. ..... 405/262; 405/284; 405/286

[58] Field of Search ..... 405/248, 286, 405/285, 262, 258; 52/605, 603

[56] References Cited

U.S. PATENT DOCUMENTS

| | | | |
|---|---|---|---|
| 4,374,798 | 2/1983 | Mercer . | |
| 4,802,320 | 2/1989 | Forsberg . | |
| 4,825,619 | 5/1989 | Forsberg . | |
| 4,914,876 | 4/1990 | Forsberg . | |
| 4,957,395 | 9/1990 | Nelson . | |
| 5,044,834 | 9/1991 | Janopaul, Jr. et al. . | |
| 5,161,918 | 11/1992 | Hodel . | |
| 5,214,898 | 6/1993 | Beretta | 405/284 X |
| 5,257,880 | 11/1993 | Janopaul, Jr. et al. . | |
| 5,417,523 | 5/1995 | Scales . | |
| 5,505,034 | 4/1996 | Dueck . | |
| 5,511,910 | 4/1996 | Scales . | |
| 5,540,525 | 7/1996 | Miller et al. . | |
| 5,816,749 | 10/1998 | Bailey | 405/284 X |

FOREIGN PATENT DOCUMENTS

| | | |
|---|---|---|
| 0472993 | 3/1992 | European Pat. Off. . |
| 2073090 | 10/1981 | United Kingdom . |
| 2235899 | 3/1991 | United Kingdom . |
| WO94/13890 | 6/1994 | WIPO . |
| WO94/23136 | 10/1994 | WIPO . |
| WO95/23897 | 9/1995 | WIPO . |
| WO95/33893 | 12/1995 | WIPO . |

*Primary Examiner*—Dennis L. Taylor
*Attorney, Agent, or Firm*—Jacobsosn, Price, Holman & Stern, PLLC

[57] ABSTRACT

A retaining wall for reinforced infill material of the type comprising superimposed courses of modular blocks, each block having a front face, a rear face, parallel upper and lower faces, and opposed sidewalls which extend between the upper and lower faces. Reinforcement material extends back from the wall into the infill material with an end portion of the reinforcement material interposed between two superimposed coursed of the wall and anchored to the wall by an anchor element which is retained in a retaining cavity between contiguous upper and lower faces of blocks in the superimposed courses. The anchor element has a spine which is of wedge-shaped cross-section for at least part of its length and has a plurality of spaced-apart projections extending from one side there of and engaging through apertures in the reinforcement material.

11 Claims, 13 Drawing Sheets

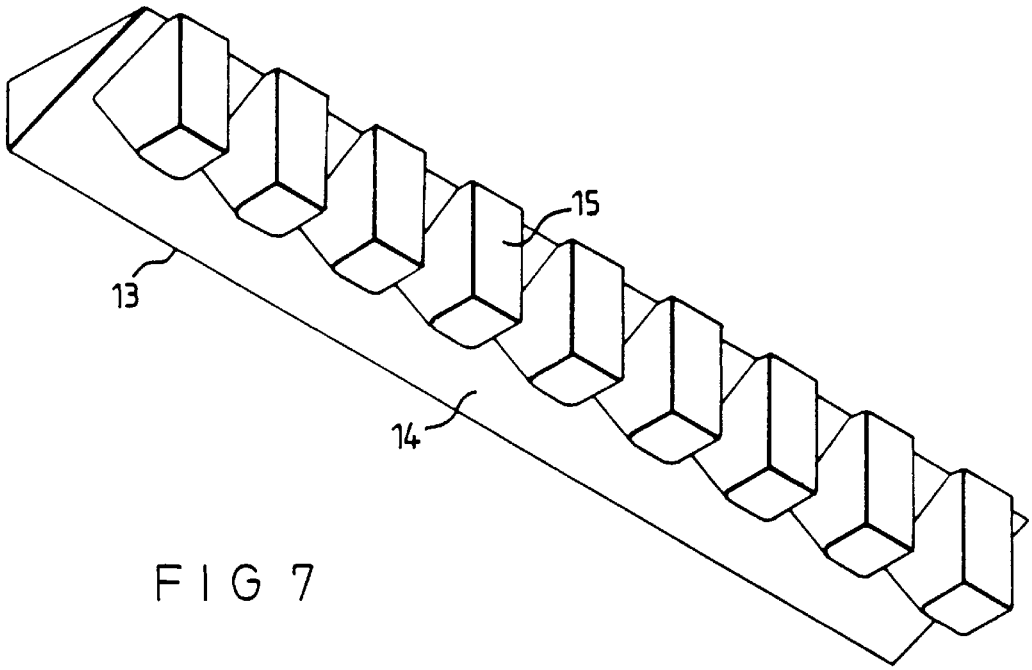
FIG 7
FIG.8
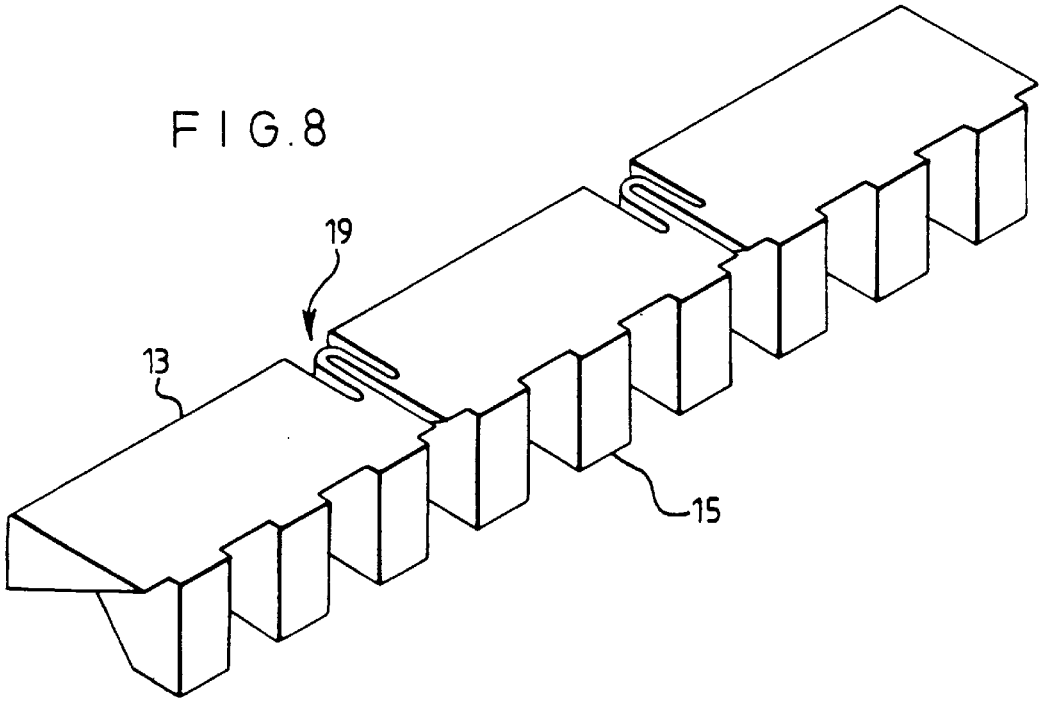

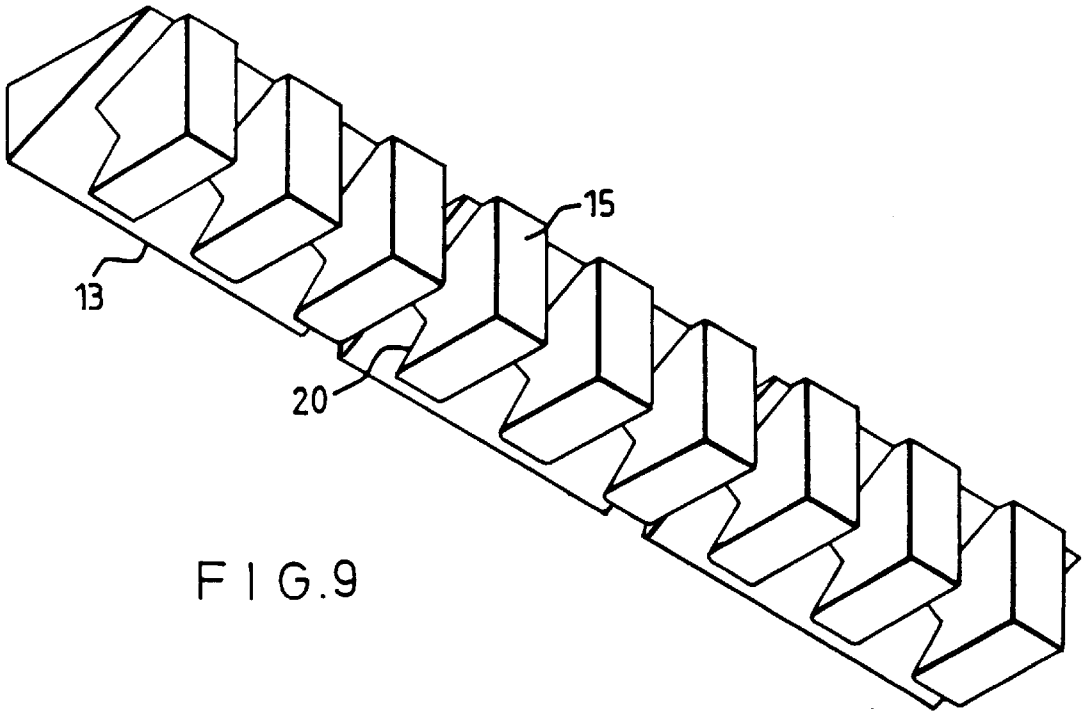
FIG.9
FIG.10
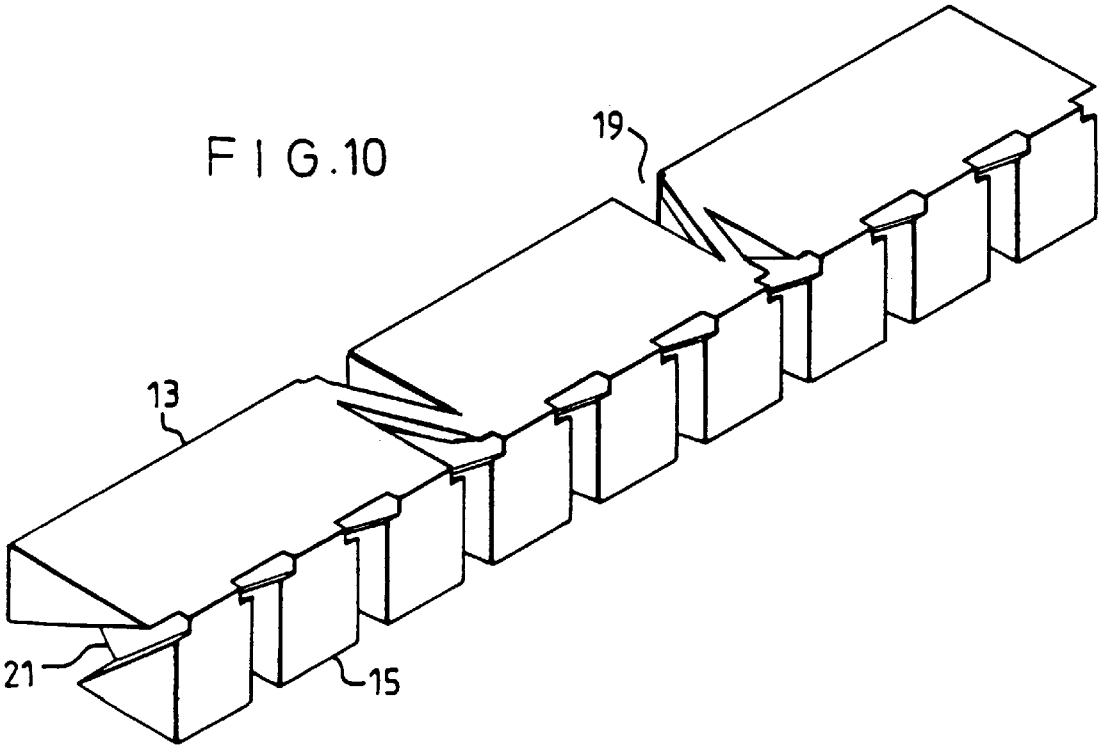

MODULAR BLOCK RETAINING WALL CONSTRUCTION

BACKGROUND OF THE INVENTION

This invention relates to a retaining wall construction, suitable for use in civil engineering soil reinforcement, of the type comprising a wall built from staggered superimposed courses of modular blocks anchored to a reinforcement material, preferaby a geogrid.

Reinforcement materials are well known in civil engineering construction work, to stabilise a reinforce large volumes of soil, such as embankments, terracing and landfill. They are usually lid horizontally between layers of compacted soil infill, with the vertical spacing between successive layers normally increasing from the bottom to the top of the infill. The reinforcement material can take many forms but is typically a mesh, grid, net or perforated sheet made from a non-biodegradable material, such as various plastics or metal wire, and in particular one of the woven or integral polymeric grids known as geogrids.

Although the present invention is not limited to the use of any specific type of reinforcement material, of particular interest are geogrids made by stretching a sheet of plastics material (such as high density polyethylene) having a pattern of holes formed therein, so as to produce a rectangular mesh with parallel spaced-apart molecularly-oriented strands interconnected by transverse bars. Such geogrids are described, for example, in the specifications of U.S. Pat. No. 4,374,798, British Patent 2 073 090 and British Patent 2 235 899, and are available commercially under the Trademark "TENSAR".

For brevity, the term "geogrid" will generally be used herein, to denote the reinforcement material employed in the invention. However, this term should be understood also to cover other forms of flexible strip or sheet-like material suitable for use in soil reinforcement, such as woven or non-woven textiles, webs or sheets, providing that these materials posess the strenghth and other properties needed for the intended use and are capable of interacting correctly with the other elements of the invention, as described below.

In many types of soil reinforcement construction, it is necessary to provide a retaining wall along at least one side of the infill, for instance to prevent erosion. Such a wall may be constructed from superimposed courses of loose-laid modular blocks, with staggered joins between the blocks in successive courses, in the conventional manner. The modular blocks may conveniently be pre-cast on or off site from unreinforced or mass concrete, preferably to a size allowing for easy handling without the use of cranes or other heavy lifting gear. The wall may be straight or curved along its length, by using blocks of an appropiate design, and may be vertical or with a batter (i.e. its face may slope backwards from bottom to top).

A retaining wall of this kind must be able to withstand the considerable pressure of of the soil infill behind it, and this can be done by anchoring it to the substantially horizontal geogrid material buried between the layers of the infill. As the construction proceeds, the wall is built up from courses of the modular blocks, an the soil infill is added behind it and compacted. Layers of the geogrid material are laid horizontally over the compacted soil, at appropiate vertical intervals, and anchored to the wall. The process is then repeated until the final height is achieved. The vertical spacing between the layers of geogrid is often greater than the height of the blocks, so that two or more courses of blocks will frequently be laid between successive layers of geogrid.

Various designs of retaining wall and methods for anchoring a geogrid to the retaining wall have been proposed in the past; but these have generally suffered from various disadvantages, such as not providing adequate strength of anchoring, not providing anchoring evenly along the major part of the interface between the geogrid and the wall, or not being readily usable with curved retaining walls.

Thus, in one type of construction, for example as described in European Patent Specification 0 472 993, the edge of the geogrid is simply trapped between two courses of blocks in the retaining wall, without any positive means of engagement between the geogrid and the wall blocks. This permits the construction of curved walls, by using suitably shaped blocks; but the retaining wall is anchored only by the strength of frictional forces between the geogrid and particles of the infill, and between the geogrid and the blocks, generated by the weight of the superimposed courses of blocks, which may be insufficient in many situations.

Other designs of blocks and forms of wall construction, such as described in U.S. Pat. No. 5,417,523 or PCT Publication WO94/13890, do provide a more secure form of attachment between the geogrid and the wall, but are suitable for use only in straight retaining walls and not in curved walls (except those with large radii of curvature), because their design does not allow for significant articulation between adjoining blocks laid within the courses of the wall. Such designs typically employ a bar-like retaining member with spaced-apart projections fox engagement with the apertures in the geogrid, with this retaining member being anchored in channels bridging the adjacent upper and lower faces of two courses of blocks in the wall, or formed in the rear vertical face of the wall blocks. Whilst these designs may provide a secure method for anchoring the geogrid to the wall evenly along its width, they also have the effect of interlocking the blocks in a substantially linear array and so cannot be used for the construction of sharply curved walls.

Similar problems arise with the wall block construction disclosed in the recently published U.S. Pat. No. 5,540,525, which uses a system of slat members keyed into slots at the intersections between the blocks to maintain vertical and horizontal alignment. This system also does not cater for the construction of stable walls with a significant degree of curvature.

Yet other alternative designs, such a described in U.S. Pat. Nos. 4,825,619 and 4,914,876, do allow for articulation between adjoining blocks and hence the construction of curved walls. However, these designs anchor the geogrid to the wall by means of rods inserted through vertically aligned bores in the superposed courses of blocks, which pass through single apertures in the edge of the geogrid inserted between the courses. The anchoring of the geogrid to the blocks is therefore concentrated at the point of contact with the rods and not distributed evenly, which limits the strength of the system and may result in distortion and failure of the geogrid. There are also other blocks, such as those described and shown in U.S. Pat. No. 5,505,034, which are of a shape suited to the construction of curved as well as straight retaining walls, but which make no specific provision at all for retaining a geogrid between the courses.

There is, therefore, a need to provide a method for securely attaching the geogrid to the retaining wall, which is versatile enough for use with the various types and forms of geogrid, and which can also be used with vertical or sloping, straight or curved retaining walls.

SUMMARY OF THE INVENTION

The present invention provides a retaining wall for reinforced infill material, which comprises:

superimposed courses of modular blocks, each block having a front face, a rear face, parallel upper and lower faces, and opposed sidewalls whir extend between said upper and lower faces, said blocks being provided with means permitting pivotal articulation along the courses of the blocks in the wall whilst maintaining vertical alignment between said courses;

a retaining cavity for a reinforcement material anchor element located between contiguous upper and lower faces of blocks in two superimposed courses, said cavity being defined by an open channel it either one of the said upper and lower faces in blocks of one course and by a substantially flat surface in the plane of the contiguous faces of the blocks in the other course, said channel extending transversely between the sidewalls of each respective block, wherein the included angle between the face of the block in which the channel in located and the rear wall of the channel is not substantially greater than 90°;

a reinforcement material (which is preferably a geogrid) extending back from the wall into the infill material with an end portion of the reinforcement material interposed between two superimposed courses of the wall and extending into said retaining cavity between said courses, said reinforcement material being anchored to the wall by of an anchor element having a spine of cuneiform arm (i.e. wedge-shaped) cross-section with a plurality of spaced-apart projections extending from one side of the spine and engaging through apertures in the reinforcement material, said anchor element being retained in said retaining cavity with the thinner edge of the spine nearer the rear face of the blocks, with said projections abutting against the rear face of the channel in the blocks of one of said superimposed courses and the side of the spine not having the projection abutting against said substantially flat surface of the blocks of the other of said superimposed courses.

Preferably, the geogrid or other reinforcement material will bridge right across the retaining cavity for the anchor element, to provide a level surface across that course of blocks from the back to the front, so as to maintain the vertical alignment and stable stacking of successive courses. However, this may not be possible or necessary with same designs of wall block, for example those having an element protruding into the cavity forward of the anchor element. In such cases, other means which are well known in the art may be employed to achieve a level surface, for instance by inserting shims between the courses at the front of the wall, or by using blocks dimensioned to compensate for this difference between the front and back faces.

In the wall constructions of the invention, the anchor element and the portion of reinforcing material anchored to it are located in a cavity in the blocks of one course only, without projecting into the next course. In this way, the anchoring means for the reinforcing material do not impede the pivotal articulation of the blocks in adjacent courses. This cavity is defined by a channel in the blocks of one course and by a substantially flat surface planar with the opposed face of the blocks in the next course, whereby the anchor element is pressed into the channel by the opposed flat surface. This flat surface can be a portion of the lower or upper face, respectively, in the block itself in the next course. However, it may sometimes be advantageous to manufacture blocks with a channel both in their upper and lower faces; and, in such a case, the flat surface in the plane of one of the faces may be provided by a separate element inserted into the channel of that face. Embodiments of both of these alternatives are described below and illustrated in the drawings.

The means for permitting pivotal articulation along the courses of the blocks in the wall whilst maintaining vertical alignment between the courses may take a variety of forms which are known per se in the art from existing designs of wall block, such as interlocking or coupling members or suitably shaped blocks. Thus, there are various designs of shaped wall blocks provided with abutments or coupling portions which serve to achieve this purpose, for example as disclosed in European Patent 0 472 993 or in U.S. Pat. No. 5,505,034. In accordance with the present invention, the design of these and other suitable known wall blocks can be modified, as will be described in more detail below, so as to provide them with the retaining cavity for the anchor element specified above, and thus achieve the desired secure anchoring of the geogrid to the wall whilst still maintaining the articulation between the blocks.

However, although any such suitable means for permitting pivotal articulation along the courses of the blocks can be used in the present invention, this can most effectively be achieved by a deign which provides for "quarter-point articulation". The term "quarter-point articulation" is used to mean a design in which the articulation of the block in relation to its neighbours occurs about a pair of points each of which is located at substantially a quarter of the width of the block inwardly from its proximal sidewall. Thus, across the width of the block, each point is substantially equidistant from the sidewall and the centre line of the block; and in a conventional bonded wall, wherein superimposed courses are displaced by half a block width, alignment is maintained between the corresponding articulation points in adjacent courses. This design makes it possible to achieve the greatest freedom of pivotal articulation for the construction of curved walls, so that walls with a small radius of curvature can be built, particularly if the pivot points are located along the line of maximum width of the block and the sidewalls are suitably cambered or tapered.

In accordance with one particularly preferred embodiment of the invention, the said quarter-point articulation is achieved by a system of pivot pins which engage in cooperating pairs of bores in the respective upper and lower faces of the blocks.

Thus, in accordance with this preferred embodiment, the invention provides a retaining wall for reinforced infill material, which comprises:

superimposed courses of modular blocks, each block having a front face, a rear face, parallel upper a lower faces, and opposed sidewalls which extend between said upper and lower faces;

each block having a pair of bores in each of its upper and lower faces, symmetrically disposed between said apposed sidewalls and extending at least partly through the block in a direction substantially perpendicular to said upper and lower faces, with the centers of the bores in each pair equidistant from the front face of the block and the distance between said centres being the same for the pair in the upper face as for the pair in the lower face of the block, the bores in the upper faces of the blocks in any one course being in alignment with corresponding bores in the lower faces of blocks in a course immediately above it (if any) so as to provide conjoined bores between vertically contiguous blocks in the two courses;

pivot pins retained in said conjoined bores, in pivotal engagement with at let one of said vertically contiguous blocks, the said bores being thus shaped and positioned in said block so that the pivot pins in said conjoined bores provide pivotal articulation along the courses of the block in the wall whilst maintaining vertical alignment between said courses;

a retaining cavity for a reinforcement material anchor element located between contiguous upper and lower faces of blocks in two superimposed courses, said cavity being defined by an open channel in either one of the said upper and lower faces in blocks of one course and by a substantially flat surface in the the plane of the contiguous faces of the blocks in the other course, said channel extending transversely between the sidewalls of each respective block along a line between the said bores and the rear face of the block, wherein the included angle between the face of the block in which the channel is located and the rear wall of the channel is not substantially greater than 90°;

a reinforcement material (which is preferably a geogrid) extending back from the wall into the infill material with an end portion of the reinforcement material interposed between two superimposed courses of the wall and extending into said retaining cavity between said courses, aid reinforcement material being anchored to the wall by means of an anchor element having a spine of cuneiform (i.e. wedge-shaped) cross-section with a plurality of spaced-apart projections extending from one side of the spine and engaging through apertures in the reinforcement material, said anchor element being retained in said retaining cavity with the thinner edge of the spine nearer the rear face of the blocks, with said projections abutting against the rear face of the channel in the blocks of one of said superimposed courses and the side of the spine not having the projections abutting against said substantially flat surface of the blocks of the other of said superimposed courses.

However, "quarter-point articulation" can also be achieved by different means, not involving pivot pins and bores. Thus, any suitable design can be employed in which projections located on either the upper or lower face of blocks in one course bear against cooperating surfaces on the opposed faces of blocks in a vertically adjacent course, with contact occuring at substantially the quarter-points across the width of the blocks. For example, this can done by providing the blocks with one or more projections extending from either the lower or upper face, which will bear against one wall of the channel for the anchor element formed in the opposing face of a vertically contiguous block, and shaping the bearing surfaces of said channel wall and/or said projections with a suitable profile which permits quarter-point articulation between blocks in vertically adjacent courses. The projection or projections can be formed integrally with the block, for instance as a continuous spine extending from the lower or upper face between the sidewalls, or as several discontinuous extensions from the face. Alternatively, the projection or projections can be separate elements, for example one or more inserts for fitting into cooperating apertures in the lower or upper face of the block. Thus, it may be convenient to manufacture the blocks with channels both in their upper and lower faces, and to fit a suitable insert in one face when building the wall. In this latter case, one surface of the insert (rather than the face of the block itself) may also define one face of the cavity for the anchor element. Specific embodiments providing such quarter-point articulation, with either integral or separate elements, are illustrated in the drawings and described in more detail below.

The invention also provides modular wall blocks and reinforcement material anchor elements for use in construction in the retaining wall defined above.

In most instances, the modular blocks will be dry-laid (i.e. without the use of mortar) in staggered courses, so that the blocks in any one course overlap the joins between blocks in the course above or below, thus providing a bonded structure similar to that used in bricklaying.

The modular blocks of the invention may be made from materials and by techniques well known in the civil engineering art for blocks generally used in retaining walls and the like. For example, they may be cast from unreinforced concrete, either on or off site, though other materials may also be used if their mechanical properties are suited to the intended construction, for example lightweight materials such synthetic polymer foams.

The size shape of the modular blocks may be adapted to suit the construction of walls of specific design, in accordance with principles which are per se well known in the art. For example, it will often be preferred for the sidewalls to converge towards the rear face of the block, so that the block tapers from front to back. This shape facilitates building of curved as well as straight walls, by laying the blocks at an appropiate angle to one another along the courses, while still maintaining the requisite alignement between the conjoined bores (or other means for maintaining alignment) in the superimposed courses. Similarly, the front faces of the blocks may be curved or cambered, to provide the desired profile for the exterior face of the wall, and may have a textured or decorative finish if desired. The positioning of the bores in relation to the shape of the front face and sidewalls, in the preferred embodiment of the invention, so as to allow for articulation of the courses of blocks in a cued wall, and also to allow construction of walls with a batter, is described in more detail below.

It is an important advantage of a preferred embodiment of the invention that the layers of geogrid laid between two courses of blocks can bridge across the retaining cavities in the blocks, and preferably extend substantially across the whole width of the blocks between the back and front faces. Also, the anchor elements (and more particularly the projections engaging with apertures in the geogrid) are substantially contained within the retaining cavities in one course of blocks, and abut against the substantially flat faces of the blocks in the other course. As a result of this combination of features, the blocks in the two courses are uniformly separated from front to back just by the thickness of the geogrid, enabling the construction of stable walls without the need for shimming or for blocks of a special shape. Moreover, these features also enable articulation between the blocks and the building of curved walls, as described more fully below. It is, therefore, preferred that substantial areas of the upper and lower faces of the blocks should have flat surfaces, in order to maximize these advantages.

Another important advantage of the invention is the locking action of the anchor element in the retaining cavity, described more fully below with reference to the drawings, which provides very positive anchoring between the geogrid and the wall blocks. In order to maximize this locking action, the included angle between the face of the block in which the channel is located and the rear wall of the channel should be 90° or less, so that forces tending to pull the geogrid away from the wall will lock the retaining element more tightly in the channel rather than pulling it out of the channel and forcing the courses of blocks apart. However, it should be understood that this angle may be increased to more than 90° by a small amount, if necessary to facilitate the moulding of the channel in the blocks, without significantly compromising the locking action or departing from the principles of the invention.

In other respects, the shape and size of the blocks may be chosen so as to facilitate their fabrication amid handling on site without heavy lifting gear, and the blocks may be cast with lightening holes for the same reason. Thus, a relatively simple shape with a flat base and sides, as described in more detail below by way of example, can be easily cast in am open-top box mould with suitable cores and hangers to provide the internal cavities.

In a preferred embodiment of the invention, the blocks are linked to each other by a system of pivot pine and cooperating bores. Each block has a pair of bores in its upper face and a pair of bores in its lower face, which are substantially perpendicular to these faces. In building the wall, as the blocks are laid course by course, pins are inserted into the bores in the upper face of each block, with a portion of the pin protruding above the level of the block. The blocks in the second course are then laid over those in the first course, so that the bores in the lower faces of the blocks in the new course are in alignment and engage with the pins protruding from the corresponding bores in the upper faces of the blocks in the first course. This is then repeated for every course except the topmost one. If the successive courses are staggered, as is usual, then every blocks is connected by two pivot pins to two blocks in the course below (except for blocks in the lowermost course) and by two pivot pins to two blocks in the course above (except for blocks in the topmost course).

Naturally, it is to be understood that this arrangement applies to blocks in the body of the wall and may be modified appropiately for blocks at the ends or corners of the wall, or wherever blocks with a special shape are needed.

The blocks in the first course be laid along a curve, for the construction of a curved wall, if the blocks are shaped appropiately as explained above, with a taper from the front to the rear of each block. The blocks in each of the following courses are then superimposed on those below, following the same curve but with the bores in their lower faces still engaging with the pins protruding from the blocks below, because each block has a degree of rotational freedom in relation to its neighbours through the pivoting articulation which is provided by the system of cooperating bores and pins in the present invention. Thus, the courses of blocks are securely held in proper alignement with each other by the pivot pins connecting them together throughout the wall structure, but it is nevertheless still possible to build curved as well a straight walls.

In particular, the requisite degree of freedom for pivotal articulation can be provided by forming the bores in the upper and/or lower faces of the blocks so that they are elongated laterally in cross-section, along a line extending between the sidewalls of the blocks. Alternatively, this can also be achieved with bores of circular cross-section, if the sidewalls are radiused towards the front face, the centres of the bores are aligned along the widest part of the block, and the distance between the centres of the two bores is twice the distance between each of the centres and the radiused edge of the block. Both of the alternatives are described in more detail below, with reference to the embodiments of the invention which are exemplified in the drawings.

In many embodiments of the invention, the pins will have a circular cross-section throughout their length, to provide the requisite pivotal articulation in cooperation with bores of circular or elongated cross-section in the upper and lower faces of the blocks, as described above. However, the objects of the invention can also be achieved if the pins are free to rotate in only one of the two sets of conjoined bores (i.e. the bores in either the lower or the upper faces of the blocks in two superimposed courses) and are fixed against rotation in the other set of bores. Thus, by way of example, the pins may have a rectangular cross-section along part of their length, for placement in one set of cooperating rectangular bores, and have a circular cross-section along the remainder of the length, to pivot in the other set of bores as already described. This arrangement can sometimes be advantageous by providing a more positive location for the pins in the blocks and, therefore, better alignment of blocks in the wall.

It will be understood, of course, that the relative dimensions and shapes of the bores and pin should be chosen so as to allow easy insertion of the pins and pivotal articulation of the blocks, as described above, whilst restricting the play of the pins in the bores to an acceptable degree and ensuring satisfactory alignment of the blocks in the wall. Their dimensions should also be selected so as to provide satisfactory strength in the connection between the blocks, in relation to the materials used for these components and the forces to be transmitted by the pins, including shear forces between the blocks caused by horizontal pressure from the soil or other infill behind the wall.

The bores in the upper face of the blocks may be blind and of a depth selected so as to provide an adequate length of pin protruding from the blocks, for engagement with the bores in the lower face of the blocks in the course above. Alternatively, this may be achieved with either blind or through bores, by appropiately shaping the pins in relation to the bores, for instance by providing them with a step or skirt intermediate between their ends, thus restricting the length of the pin which will fit into the bores.

If the blocks are fabricated with pairs of through bores, extending between their upper and lower faces, then it is also possible to use longer pins which extend through several courses of blocks, However, this embodiment is not suited to the construction of walls with a batter. For such walls, it is preferred to use an embodiment of the invention in which, for each block, the pairs of bores in the upper and lower faces are not vertically aligned with each other, so that the bores in the lower face are closer to the front face of the block. When curses of such blocks are superimposed with the pins engaging in the bores, an described above, each successive course will be stepped back from the one below by a distance corresponding to the displacemt between the pairs of bores in the upper and lower faces. This embodiment is described in more detail below, with reference to the drawings.

It is also possible for the blocks to be formed with two pairs of bores in either the top or the bottom face, one of these pairs being aligned with the bores in the other face and the other pair being displaced therefrom. In this way, the same design of block can be used for the construction of both types of wall, that is vertical walls or walls with a batter.

Alternatively, a batter can be generated by the use of appropiately shaped pins. For example, if the pins are formed with upper and lower sections which are eccentric to each other, this will provide a stepped effect between succesive courses of superimposed courses, in the same way as the displaced pairs of bores in the upper and lower faces of the blocks described above. A limited degree of batter can also be achieved by means of pins with two sections having different concentric diameters, in conjunction with tapering bores having a sloping rear circumference, as will be described in more detail below with reference to the drawings.

The material used for the pivot pins should be chosen to provide the requisite combination of strength and other properties in accordance with the criteria described above and the design parameters of the intended wall construction.

Thus, mild steel will frequently be used, but alternatives may be suitable in some cases, including other metals and polymers.

Although the above description of wall construction refers to one preferred embodiment of the invention, using a system of pivot pins a cooperating bores for achieving alignment and articulation between the blocks, it will be evident that the same method of construction may readily be adapted to the use of alternative means for achieving this, including the prior art designs already referred to and the other preferred embodiments described below with reference to the drawings, without departing from the principles and spirit of the present invention.

The anchor elements used in the invention may also be made from a variety of materials, including polymers and metals, an will be described in more detail below with reference to the embodiments illustrated in the drawings.

BRIEF DESCRIPTION OF THE DRAWINGS

The invention will be described in more detail with reference to some specific embodiments which are illustrated in the accompanying drawings, wherein:

FIGS. 7, 8, 9 and 10 are detailed perspective views of several embodiments of the anchor element used in the invention;

DETAILED DESCRIPTION OF THE INVENTION

Figure 1:
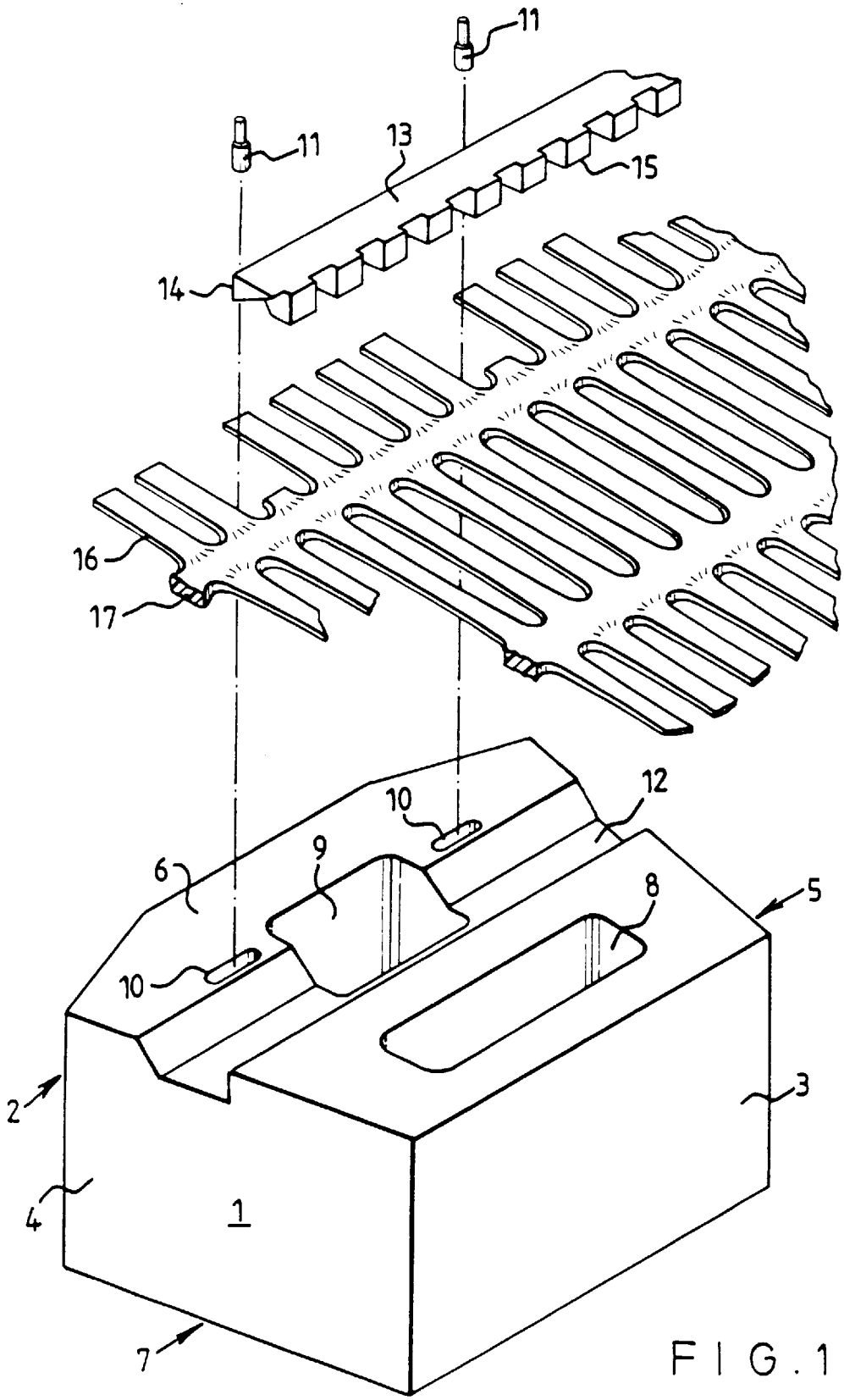
FIG. 1 is an exploded perspective view of a preferred embodiment of the invention employing pivot pins and bores for articulation.

Referring to FIG. 1, the modular wall block 1 has a cambered front face 2, with sidewalls 4 and 5 tapering bark towards the rear face 3. The top and bottom faces 6 and 7 are generally flat, but the top face 6 is formed with a channel 12 running between the two sidewalls and parallel to the rear face. The block 1 is preferably made from unreinforced precast concrete, though other materials may also be used if their mechanical properties are suited to the intended construction. The block may also be formed with lightening holes 8 and 9, such as illustrated in FIG. 1, of such shape and size as to reduce its weight without compromising its strength. Such holes may penetrate right through the block, or blind holes may be provided in the top and/or bottom faces of the block.

The shape of modular block illustrated in FIG. 1 has several advantages. Its cambered front and rearwardly tapering sides allow it to be used in the construction of curved as well as straight retaining walls. If desired, it can be formed with a decorative front face, which can be protected against damage by resting the block on its flat rear face 3 before it is put in place in the wall. This can be encouraged or assisted by the size and placement of the lightening holes 8 and 9. The dimensions of the block are not critical and may be chosen to suit the desired use, but it is often convenient to limit its dimensions and hence its weight, so as to allow for easy handling during the construction of the retaining wall.

Figure 3:
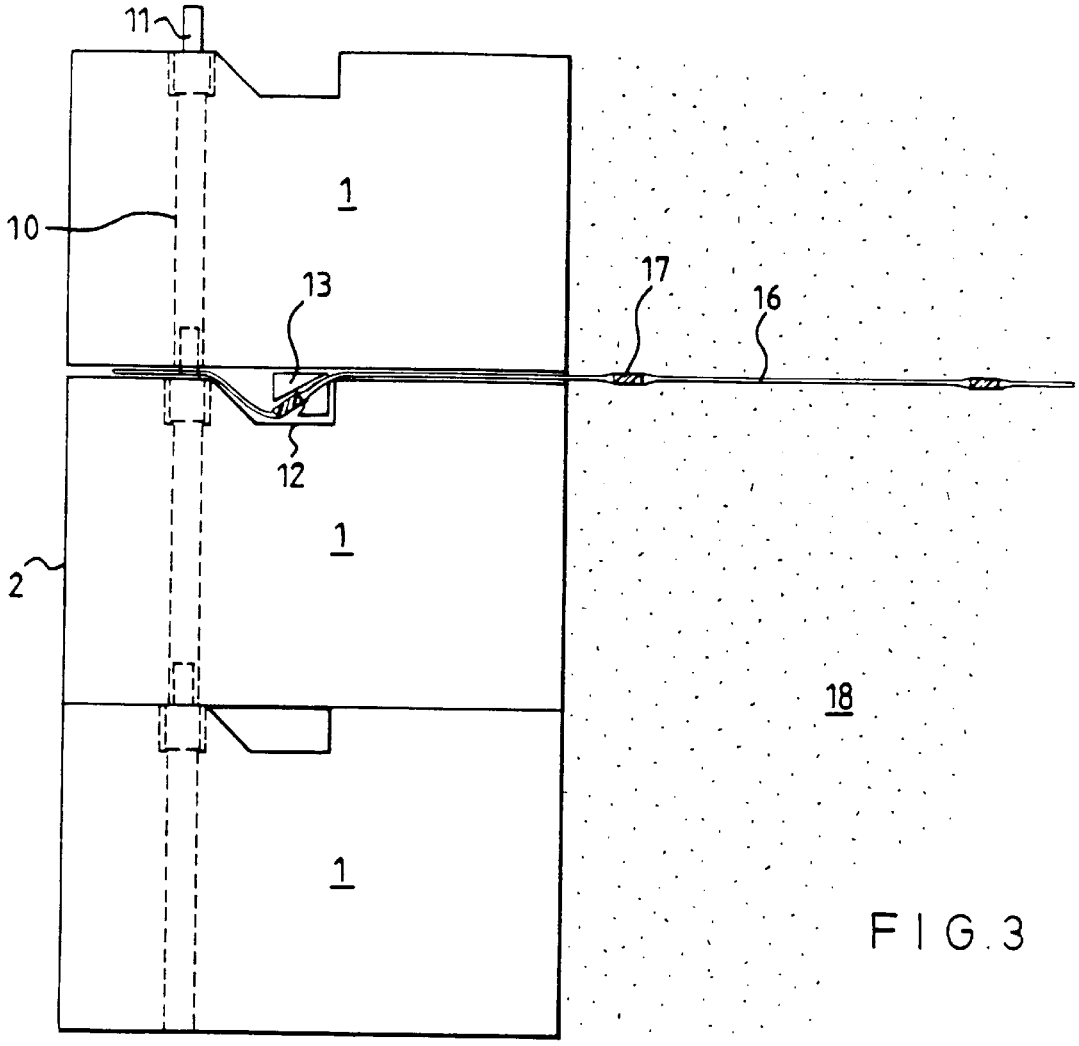
FIG. 3 is a side sectional view of a retaining wall built in accordance with the invention, showing an example of a wall having a vertical front face.
Figure 4:
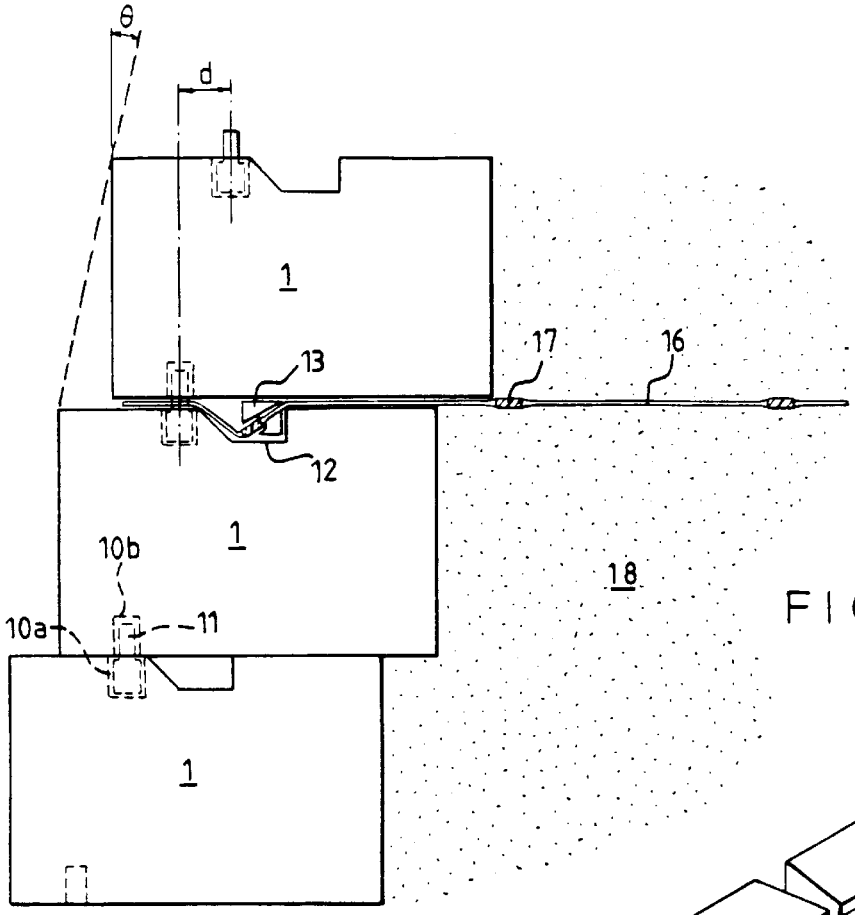
FIG. 4 is a side sectional view similar to that in FIG. 2, but showing an example of a wall having a sloping front face.

The block 1 is also provided with a pair of vertical bores 10 symmetrically disposed across its width, for engagement with the pins 11. The bores 10 may extend trough the whole height of the block, between the upper and lower faces 6 and 7, as shown in FIG. 3; or there may be pairs of blind bores 10*a* and 10*b*, as shown in FIG. 4, respectively in the upper and lower faces of the block, disposed in such a way that they are properly aligned when successive courses of blocks are superimposed on one another. As shown in FIG. 3, the bores 10 and pins 11 may be suitably shaped so as to prevent the pins from falling too far into the bores, for example by forming them with a tapered or stepped diameter. Also, when the vertical bores 10 pass continuously through the whole height of the block, as shown in FIG. 3, a continuous rod may be used which passes through several superimposed courses of blocks, as an alternative to the individual pin 11 shown in the drawings.

Figure 5:
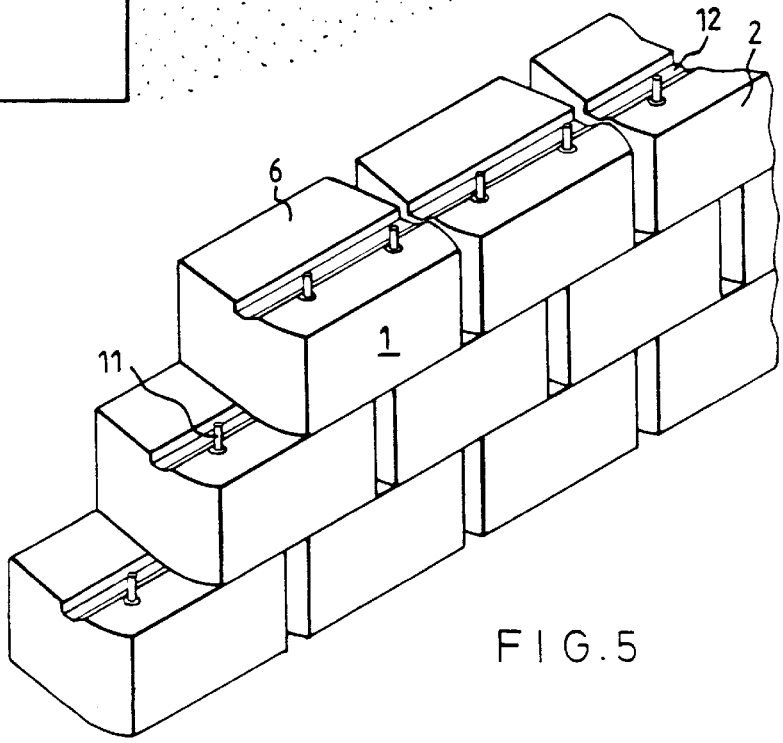
FIG. 5 is a perspective view of the wall construction shown in FIG. 3, with the geogrid and anchor element omitted for clarity.

The blocks 1 are assembled to form a retaining wall in the conventional manner, as shown in the perspective view of FIG. 5, with superposed rows or courses of blocks. The symmetrical disposition of the bores 10 and pins 11 allow the blocks in each course to bridge the joins between the blocks in the vertically adjacent course or courses, as is conventional in the construction of a wall from modular blocks. However, this design also allows for articulation between adjacent blocks along the length of each course, if desired, so as to permit the construction of curved as well as straight walls, in the manner described below.

As may be seen from the perspective view of the wall assembly in FIG. 5, the pins 11 connecting each block 1 with its neighbours above and below it can act as pivots, allowing for articulation along each course of blocks and hence the construction of a curved wall. The desired degree of articulation can be achieved by appropriate selection of several factors, alone or in combination, and in particular the shapes and dimensions of the blocks themselves in relation to the bores 10 and the pins 11. Thus, the camber or curvature of the front face 2 of the block, and the taper of the sidewalls 4 and 5 towards the rear face 3, should be such as to allow for the placement of the blocks in a wall having the desired radius of curvature. It may also be necessary to allow for relative lateral movement between the pins and the blocks, by shaping the bores 10 to be laterally elongated as shown in FIG. 1. This lateral movements may be achieved by elongating the bores in the upper or lower faces of the blocks, or in both sets of faces, depending on individual requirements.

Figure 2:
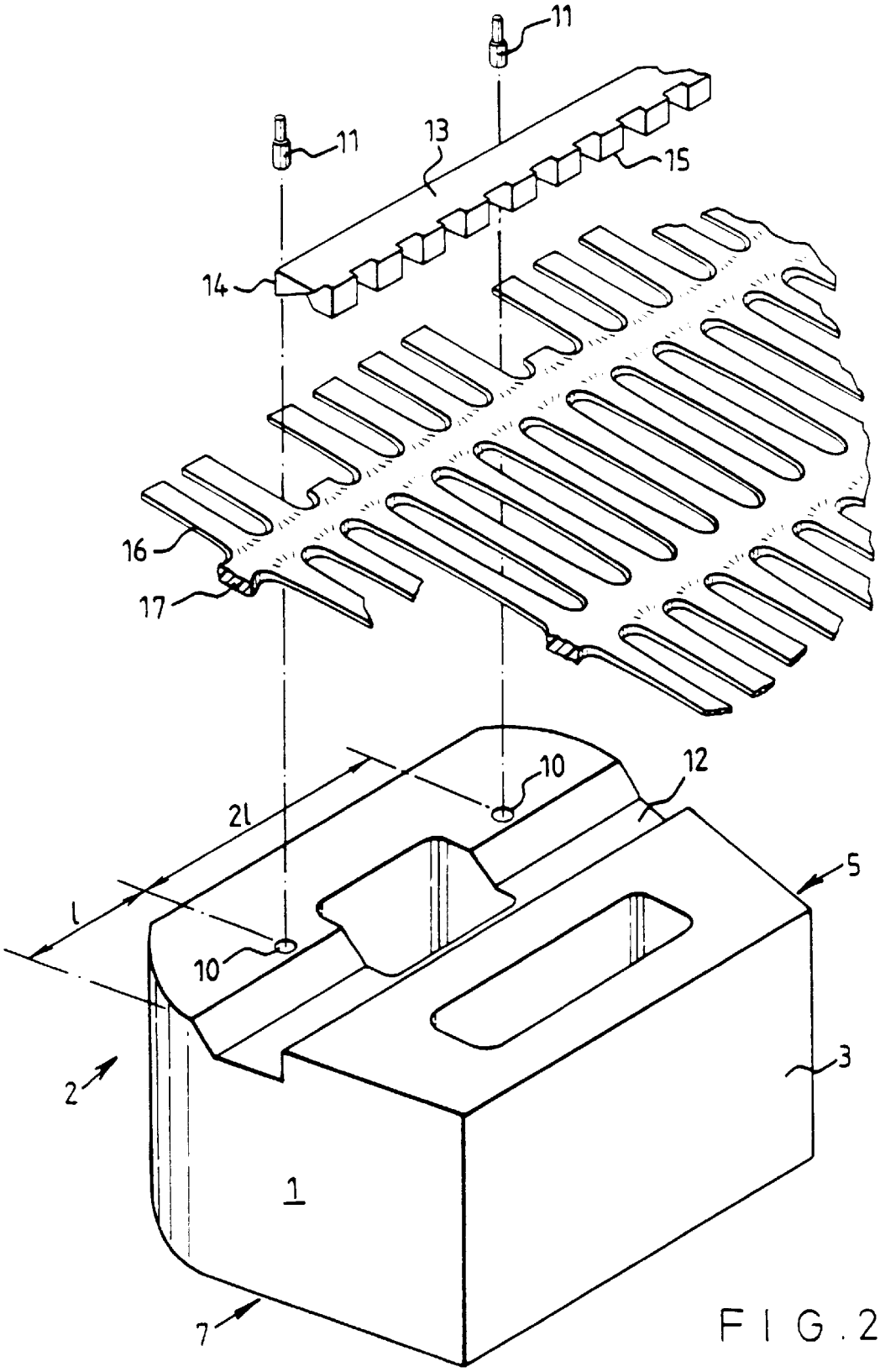
FIG. 2 is a view similar to that in FIG. 1 but with a different design of wall block.

Alternatively, articulation of the block in possible in both directions with circular bores and pins by means of the arrangement illustrated in FIG. 2. In this embodiment of the invention, the block 1 is of generally the same shape as that shown in FIG. 1, tapering from the front face 2 to the rear face 3, but the sidewalls 4 and 5 are radiused toward the front face 2. The centres of the vertical bores 10 are aligned along the widest part of the block, and the distance between the centres of the two bores (2l) is twice the distance between each of the centres and the radiused edge of the block (l). In other words, the centres of the bores are spaced inwardly from the edge by one-quarter the width of the block, in accordance with the "quarter-point articulation" design principle explained above. The radiused front edges of the block are curved along an arc which is centered an the centres of the respective bores 10 and with a radius (l). This design permits each block to pivot about the pin 11 in either direction relative to the neighbouring blocks in the same course, so that a wall can be constructed with a straight, convex or concave face, as desired.

The preferred embodiments of the invention illustrated in the drawings show the use of a geogrid made from a plastics material such as high density polyethylene, of the type available commercially under the Trademark "TENSAR", although the invention is not limited thereto.

As may be see from FIGS. 1 and 2, the geogrid consists of parallel elongated strands interconnected by transverse bars, forming an array of slots therebetween. In the construction of a retaining wall, the geogrid is laid horizontally with its front edge sandwiched between two courses of the blocks 1, with one of the transverse bars 17 aligned with the channel 12 in the top face of the blocks. The anchor element 13 consists of an elongated bar or spine 14 with teeth 15 protruding therefrom, the shape, size and pitch of the teeth being designed for engagement with the slots in the geogrid 16 so as to abut against the transverse bar 17. As may be seen from FIGS. 3, 4 and 6, the intrinsic flexibility of the geogrid allows the anchor element 13 which is in engagement with the transverse bar 17 to be forced down into the channel 12 in the upper face of the block 1, by the weight of the superimposed upper layer of blocks. The design of the anchor element 13 and the slot 12 results in a positive locking action when a tension is applied to the geogrid 16, so that the top face of the anchor element 13 bears against the lower face of the superimposed block 1, and the rear vertical face of the anchor element's teeth bear against the rear vertical face of the slot 12, thus securely anchoring the geogrid to the wall. Moreover, the engagement of the multiple teeth 15 through multiple apertures along the transverse bar 17 spreads the load evenly along the width of the geogrid 16, thereby maximising the anchoring strength of the structure. However, it should be understood that, depending upon the design of the geogrid and other parameters, it may not always be necessary to provide the anchor element 13 with teeth for engagement in every one of the slots along the transverse bar 17, so that the teeth 15 may optionally be spaced apart for engagement with, for example, alternate slots or every third slot.

Figure 6:
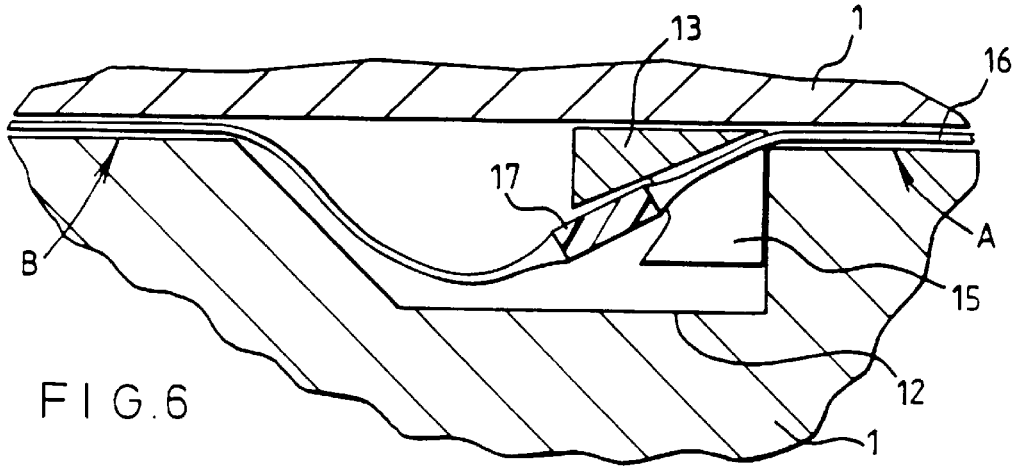
FIG. 6 is an enlarged sectional view of the embodiments in FIGS. 3 and 4, showing in more detail the means for anchoring the geogrid to the wall.

The shape and dimensions of the anchor element 13 may be varied so that the anchor element provides a good fit with the apertures in the geogrid 16 and with the channel 12 in the modular block. However, in all cases its shape and dimensions must be such that substantially the whole thickness of the anchor element 13 can fit within the channel 12, between two superimposed courses of blocks, when the anchor element is attached to the geogrid 16, as shown in FIGS. 3, 4 and 6. This feature ensures that the anchor element and geogrid will not obstruct the relative movement between the opposed faces of vertically adjacent blocks in different courses, thereby permitting articulation of the blocks about the pins 11 and hence the construction of curved walls. In this respect, the present invention can be contrasted with previous designs in which the anchor element for the geogrid acts to interlock the superimposed courses of blocks one with another, and thereby prevents or severely restricts articulation.

Although the drawings illustrate embodiments of the invention in which the channel 12 for the anchor element 13 is located in the top face 6 of the block 1, and in the wall construction this bears against the substantially flat faces 7 of two superimposed block in the next higher course, it will readily be appreciated that this arrangement can be inverted simply by rotating the blocks 1 through 180° about a horizontal axis. Thus, the channel 12 will then be situated in the bottom face of the block 1, and this will then bear against the substantially flat opposed faces of two adjacent blocks in the next course below. In this arrangement also, as with that illustrated in the drawings, the anchor element 13 will lie within the channel 12 when attached to the geogrid 16, so that it does not prevent movement between the opposed faces of the blocks in the two courses and thus allows for articulation of the blocks about the pins 11. This provision for articulation combined with a secure means of anchoring the geogrid to the wall blocks is an important advantage which is provided by the present invention.

The requirement for articulation will also determine the width of the geogrid material 16 (e.g. along the transverse bars 17 shown in the drawings) and the length of the anchor elements 13. Thus, in building a straight wall, the channels 12 in the blocks along one course will all be substantially aligned one with another. In such a case, the geogrid material and anchor elements 13 may bridge two or more adjacent blocks, which may help to strengthen and stabilise the structure, and their dimensions may be chosen accordingly. On the other hand, this is not normally possible when building a curved wall because the channels 12 will not all be aligned one with another, and in such a case the geogrid material may be cut into strips of a width corresponding to the width of individual blocks, with the anchor element 13 having a corresponding length; or even narrower widths may be used, as may more than one of the elements 13 per block. This will ensure her, even in a curved wall, each anchor element can engage firmly along its whole length with the wall of the channel 12 and with the transverse bar 17 in the geogrid material, thus spreading the load along the whole width of the wall block and geogrid material, and therefore maximising the anchoring strength. Of course, it will be understood that in such a curved wall arrangement the strips of geogrid material will overlap or diverge as they extend back from the wall, depending on whether the face of the wall is convex or concave.

Depending on the height of wall to be constructed, different grades or types of geogrid way be needed at different levels, or different constructors may wish to use different types or grades of geogrid for different walls. Consequently, the thickness of the geogrid portion 16 trapped between the faces of two superimposed courses of blocks will vary, depending on such different types or grades of geogrid. For example, with "TENSAR" geogrids this thickness may vary from 0.7 mm to 2.6 mm, depending on the grade selected. Because the blocks are spaced apart vertically by the geogrid 16 by an equal amount, both behind and in front of channels 12, walls may be constructed from standard blocks and any grade or type of geogrid, without shimming or other special attention to maintain level; and this is a significant advantage provided by the present invention.

FIG. 7 shows a detailed perspective view of one embodiment of the anchor element 13, having a spine 14 of wedge-shaped cross-section and protruding therefrom teeth 15 for engagement with the apertures in the geogrid. The shape, size and spacing of the teeth 15 will, of course, depend upon the shape, size and spacing of the apertures in the geogrid, so as to achieve good engagement between the geogrid and the anchor element. Similarly, the choice of material used for the anchor element may depend upon the choice of geogrid used in a particular construction. For example, if the geogrid is made from a plastics material then the anchor element may also be moulded from a suitable plastics material, such as high density polyethylene, but the anchor element may also be made from a metal. Also, the teeth 15 may be moulded integrally with the spine 14, or the teeth and spine may be fabricated separately and fastened together by any suitable means.

It is desirable that the teeth 15 of the anchor element 13 should occupy substantially the whole width of the apertures in the geogrid, for optimum anchoring strength. However, this is difficult to achieve in practice because the apertures in commercially produced geogrids are not at a precisely repeating pitch. Thus, the teeth of a rigid anchor element will typically not align properly with more than about three apertures of the geogrid, unless each tooth in substantially narrower than an aperture. The problem ran be overcome by the modification of FIG. 8, showing an anchor element similar to that of FIG. 7 but viewed from a different angle for clarity, in which the spine incorporates longitudinal flexible portions 19. The tolerance provided by these flexible portions allows the teeth of the anchor element to engage with the apertures in the geogrid over a longer distance whilst having a width approaching that of an aperture. Of course, the design and spacing of these flexible portion may be varied so as to suit the material of the anchor element, the required degree of flexibility, and the nature of the geogrid used.

Further preferred embodiments of the anchor element 13 are shown in FIGS. 9 and 10. In FIG. 9, the teeth 15 are provided with a projecting portion 20, which assists in ensuring that the anchor element remains in secure engagement with the geogrid during construction of the retaining wall. This tooth design is also illustrated in the detailed cross-section view of FIG. 6, which shows the engagement between the anchor element and the geogrid. In the embodiment of FIG. 10, the teeth 15 are provided with lateral slots 21 adjacent the spine 14, which also ensure a positive engagement between the anchor element and the geogrid. This embodiment additionally incorporates flexible portions 19, but of a design slightly different from the corresponding ones in FIG. 8.

Any of the individual features described above for different embodiments of the anchor element may also be used, as appropiate, in combination in the same embodiment.

Although the present invention has been illustrated and described by way of example with reference to the use of integral polymeric geogrids, and in particular the type of geogrid having a rectangular mesh with parallel spaced-apart molecularly-oriented strands interconnected by transverse bars such as available commercially under the Trademark "TENSAR", the invention in not limited to geogrids of this type. As already stated, other types of flexible reinforcement material can also be used in the invention, including woven or non-woven textiles, webs, extruded sheets or the like made from natural yarns and fibres, synthetic polymers, metal wire, etc. It will be understood, of course, that the composition, dimensions, method of fabrication and other details of the reinforcement material should be selected for suitability to the intended purpose and the individual construction.

In particular, the reinforcement material should be flexible enough to permit it to be anchored by the anchor element 13 within the cavity 12 in the blocks of the invention, as described and illustrated herein, whilst being strong enough to stabilise the wall and infill adequately. Also, the reinforcement material must be capable of receiving the teeth or spaced-apart projections 15 of the anchor element, at least in the end portion which is intended for insertion between the courses of blocks. This can be achieved in different ways, depending on the nature of the reinforcement material, for example by punching holes of suitable shape and size in a continuous sheet material, or by allowing the teeth 15 to penetrate between the yarns in a woven textile material. If necessary, this end portion of the reinforcement material can be strengthened so as to prevent distortion or tearing, for example by means of reinforced loops, eyelets or transverse strips.

It should also be understood that the design of the anchor element 13 may be modified from that shown in the drawings, for optimum performance with other types of reinforcement material. For instance, the shape of the spaced-apart projections 15 may be modified to suit the apertures in the reiforcement material, in which they are intended to engage, or to create such apertures by themselves. Thus, when using a textile or other woven reinforcement material, the projections 15 may be shaped as teeth or pins which will penetrate between the yarns in the weave, by pressing the material against that side of the anchor element.

In the construction of the invention, it can be advantageous to code the anchor elements 13 and/or the pivot pins 11 with distictive colours. This facilitates checking on-site, to ensure that all the anchor elements and pivot pins are correctly inserted, as the wall is built up course by course. Such colour coding can be extended to the use of different colours for different types of anchor element or pivot pin, again to ensure that the correct ones are used at each point in the construction.

The modular blocks of the invention in readily be adapted to the construction of retaining walls of which the face is substantially vertical or has a batter (i.e. slopes backward from the base to the top), simply by modifying the relative alignment of the vertical bores 10 and pins 11. For example, FIG. 3 illustrates an embodiment in which the bores 10 and pins 11 of the superimposed courses of blocks are all in vertical alignment, resulting in a wall with a vertical face. The same result could also be achieved by providing each block with vertically aligned blind bores in their respective top and bottom faces, to receive the pins 11. On the other hand, FIG. 4 illustrates the construction of a wall in which the successive superimposed courses of blocks are stepped back, with the result that the face of the wall has a batter at the angle θ. This is achieved by offsetting the centres of the blind bores in the upper and lower face of each block, so that the bore in the lower face is closer to the front face of the block by a distance (d) as compared with the bore in the upper face of the same block. Consequently, when each course of blocks is laid on the one below, engaging the pins 11 in the cooperating pairs of blind bores, the upper course is stepped back by a similar distance d, as may readily be seen in FIG. 4. It is also apparent from FIG. 4 that such a stepped construction does not detract from the advantages of the invention in allowing articulation of the blocks about the pins 11, for the construction of laterally curved walls, whilst at the same time achieving secure anchoring of the geogrid 16 by means of the anchor element 13 in the channel 12.

The construction of a wall with a batter can also be achieved by other means, different from the stepped construction illustrated in FIG. 6, by appropriately modifying the design of the bores 10 and/or pins 11. For example, the through-bores 11 of FIG. 5 may be modified so that, instead of being cylindrical, they taper from top to bottom of the block but have a vertical front circumference, so that the taper is provided by a sloping rear circumference in the bore. When such an asymmetrical tapering bore is used with a conventional cylindrical pin made with two concentric diameters, each course of blocks will be stepped back from the course below by a small distance corresponding to that taper, thus providing the wall with a small angle of batter. Alternatively, a batter can be generated by the use of pins formed with upper and lower sections which are eccentric to each other (not illustarted).

It will also be readily understood that, if desired, the modular blocks themselves may be fabricated with a sloping instead of vertical front face, or with a curved face, or with a decorative face, so as to suit a particular shape or design of wall construction, without departing from the essential features and advantages of the invention described herein.

Alternative embodiments of the invention, not using the preferred system of cooperating pivot pins and bores, are illustrated in FIGS. 11–14 of the drawings.

Figure 11:
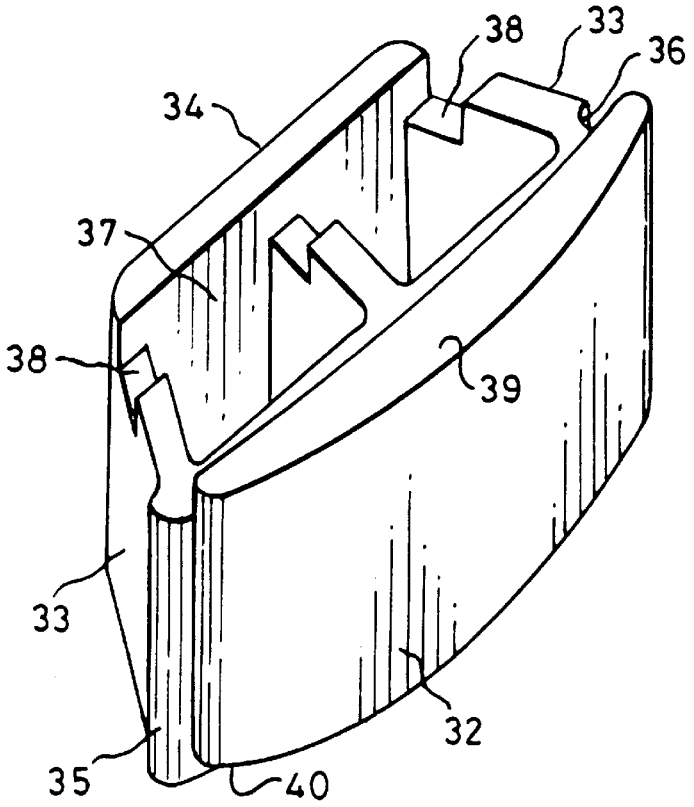
FIG. 11 shows another type of wall block for use in the invention, using a different type of alignment means.
Figure 12:
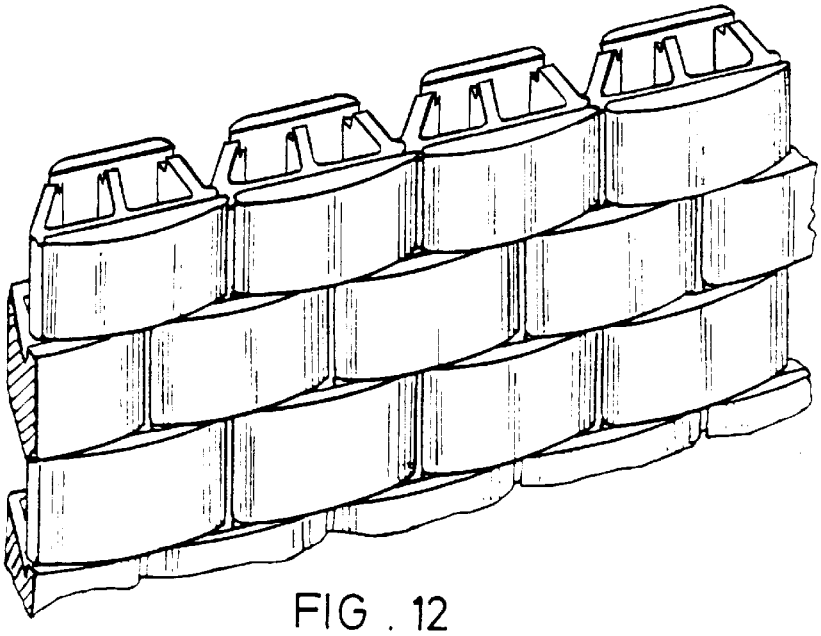
FIG. 12 is a front view of a wall construction using blocks of the type shown in FIG. 11.

FIG. 11 is a perspective top view of a wall block of the general type described in European Patent 0 472 993, but modified for use in the invention. It has a cambered front face 32, with sidewalls 33 converging towards the rear face 34. The two edges of the sidewalls nearest the front face are furnished, respectively, with a radiused ridge 35 and a correspondingly shaped groove 36, which cooperate in adjacent blocks along the same course to provide pivotal coupling between the blocks, as shown in the wall of FIG. 12, so that the blocks can be used to build curved as well as straight walls. Vertical alignment between the courses of blocks is maintained by providing the front top edge of each block with an upward step 39, for engagement with a corresponding abutment 40 in the front bottom edge of blocks in the next course above.

The interior of the block in FIG. 11 has two lightening holes 37. In the upper face of the block, the wall between these holes and the sidewalls 33 are provided with aligned recesses 38, to form a channel for the anchor element of the invention, which is retained in a cavity defined by this channel and the flat surfaces of the sidewalls in the lower faces of the blocks in the next course above. The anchor element and geogrid are not shown in FIGS. 11 and 12, but the anchoring of the geogrid to the blocks is achieved in exactly the same way as in the embodiments shown in FIGS. 1–6.

Figure 13:
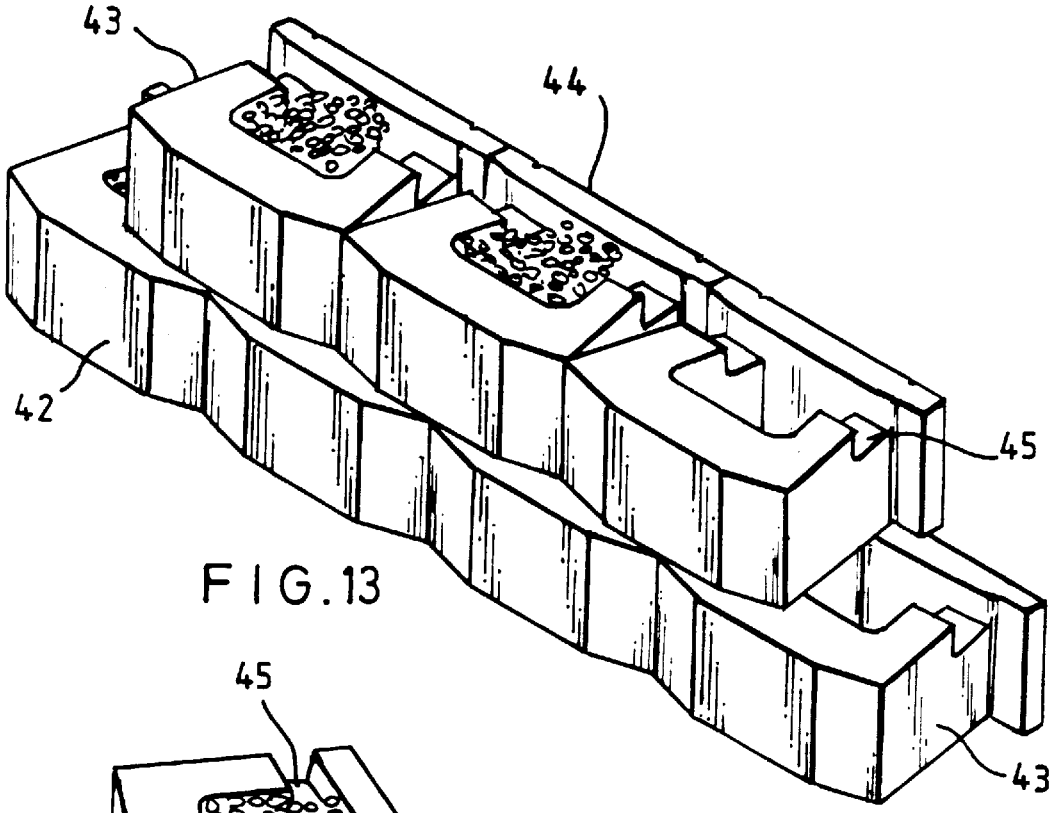
FIGS. 13 and 14 are front views of straight and curved walls constructed with yet another type of block.
Figure 14:
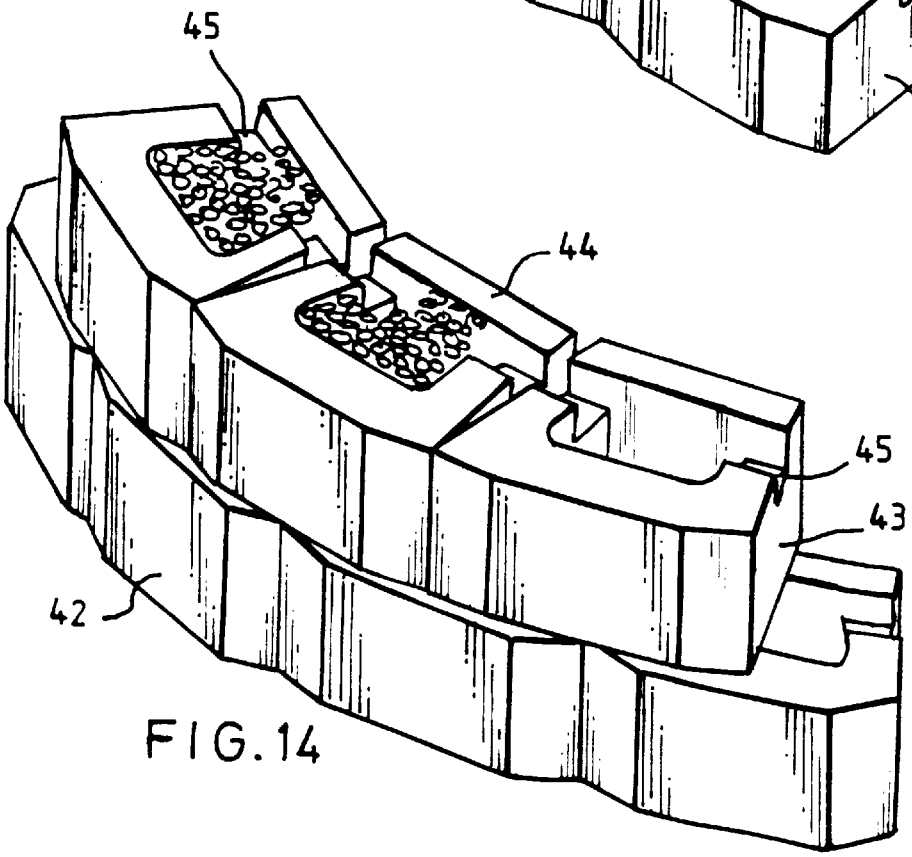

FIGS. 13 and 14 illustrate straight and curved walls constructed from blocks of the general type described in U.S. Pat. No. 5,505,034 but modified for use in the invention. The blocks have cambered front faces 42, with sidewalls 43 converging towards the rear faces 44. As described in the said patent, the lower faces of the blocks are formed with integral knobs (not shown), which protrude into the internal cavities of blocks in the next course below and thus maintain vertical alignement between the courses. This design is modified, in accordance with the present invention, by providing the sidewalls 33 with aligned recesses 45, to form a channel for the anchor element of the invention, which is retained in a cavity defined by this channel and the flat surfaces of the sidewalls in the lower faces of the blocks in the next course above. The anchor element and geogrid are not shown, but the anchoring of the geogrid to the blocks is achieved in exactly the same way as in the embodiments shown in FIGS. 1–6.

FIGS. 15, 16, 17, 18 and 19 illustrate alternative preferred embodiments, which utilise designs of wall block which achieve "quarter-point articulation" by different means.

Figure 15A:
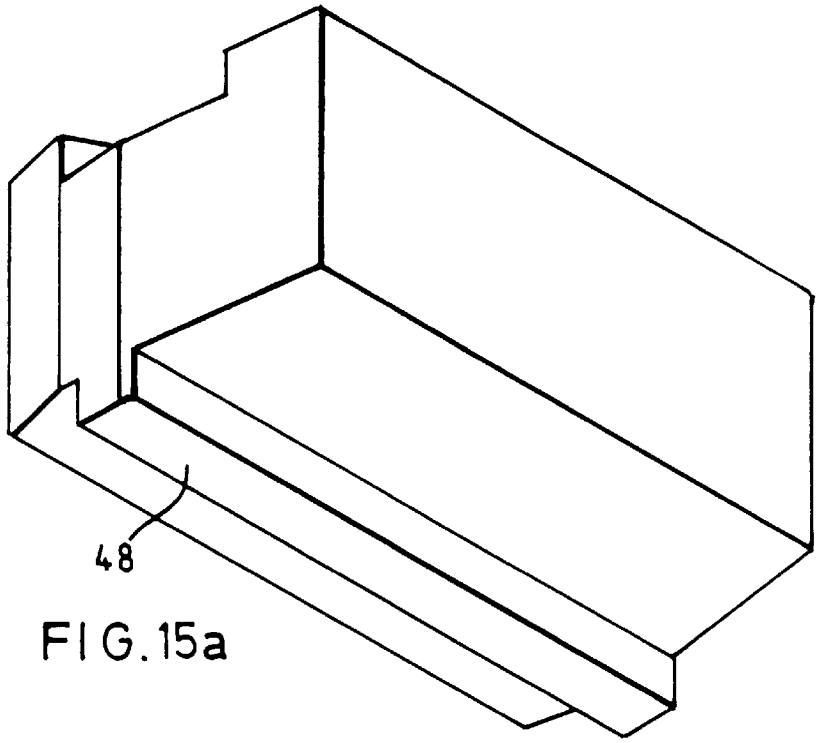
FIGS. 15 (*a* & *b*) and 16 (*a* & *b*) show perspective views from below and above of two further alternative designs of wall block, using an integral element to achieve quarter-point articulation.
Figure 15B:
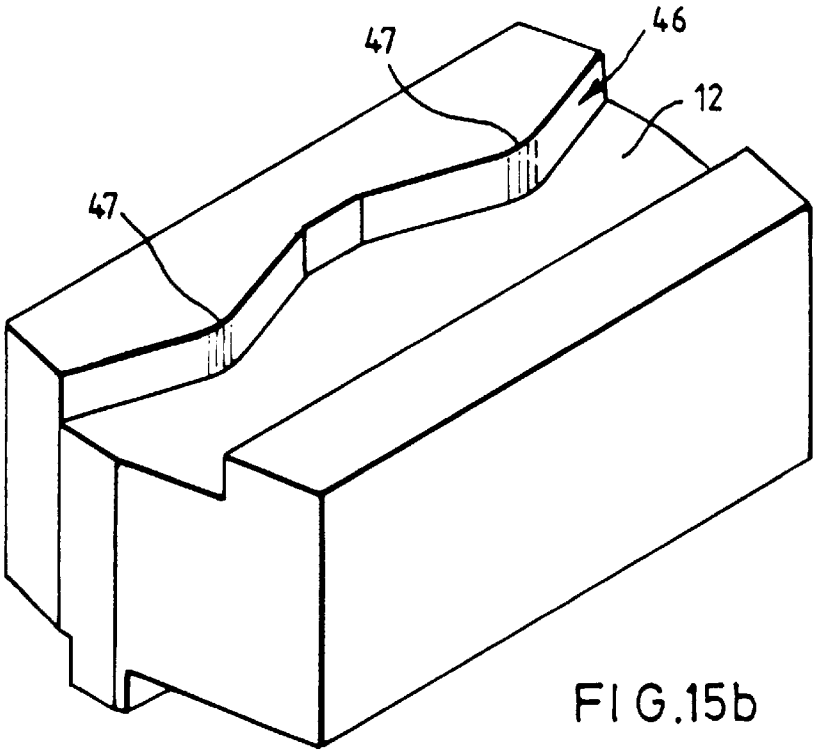

FIGS. 15*a* and 15*b* show perspective views of such a wall block from below and from above, respectively. The lower face of the block (FIG. 15*a*) is provided with a transverse spine 48 across its width, which is dimensioned for insertion in the channel 12 in the upper face (FIG. 15*b*) of the blocks in another course. The front wall 46 of channel 12 is shaped with a profile having two protruberances 47. The apices of these protruberances are located along the line of the maximum width of the block, and each apex is distant from the proximal side wall of the block by a quarter of that width. The requirements for "quarter-point articulation" are thus achieved, to allow pivotal articulation between the blocks in the building of curved walls.

Figure 16A:
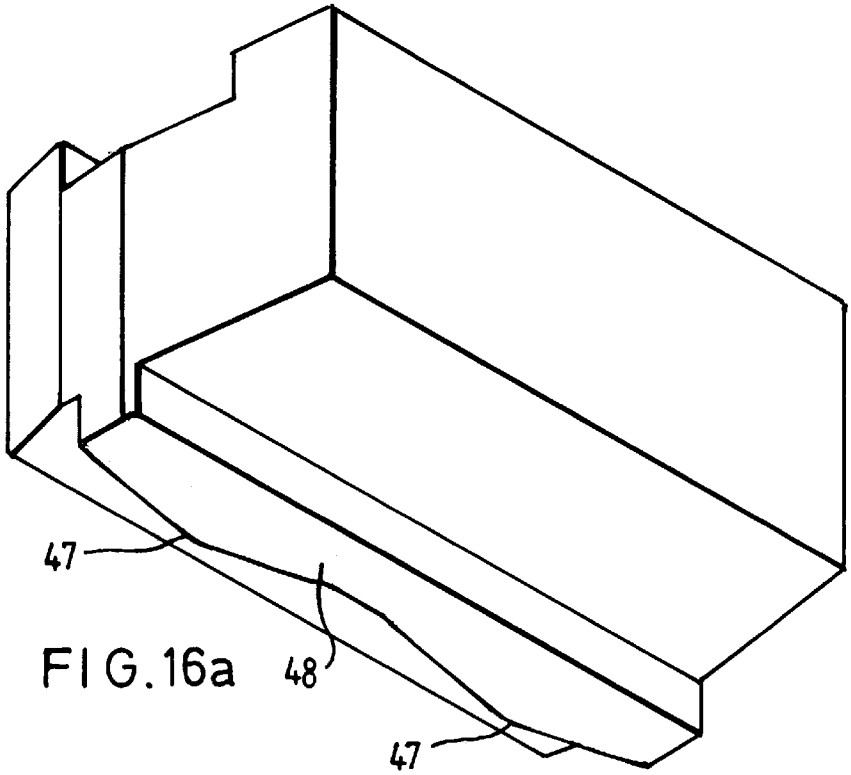
Figure 16B:
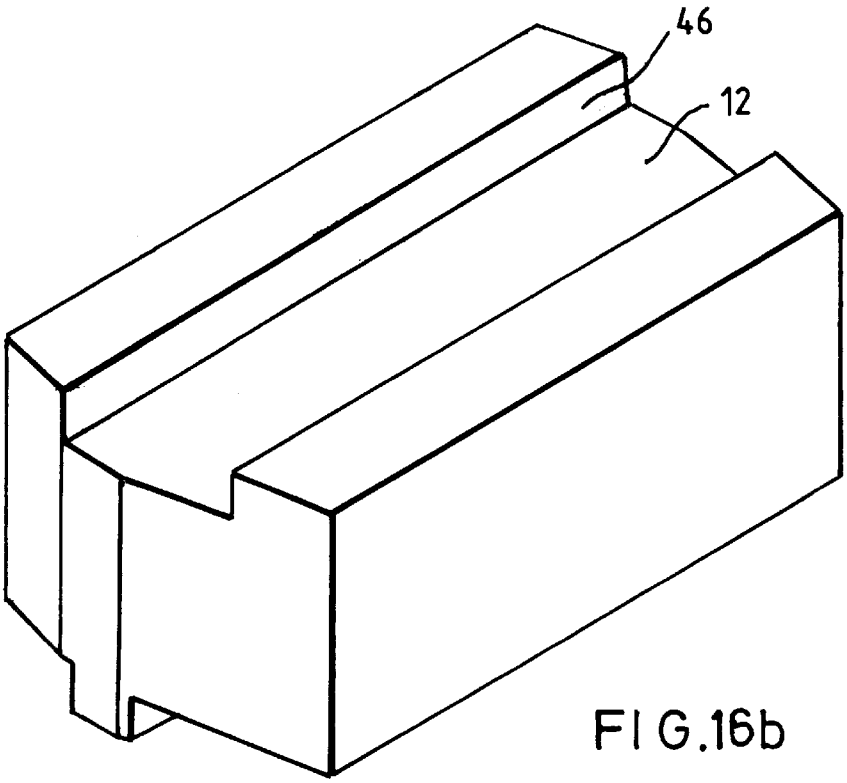

The same effect is achieved in the alternative embodiment shown in FIGS. 16*a* and 16*b*, which show a wall block of the same design as in FIGS. 15*a* and 15*b*, except that the protuberances 47 are now provided on the front face of the spine 48 (with their apices spaced at the quarter points along the width of the block, as before), and the front face 46 of channel 12 is now flat instead of being profiled.

Figure 17:
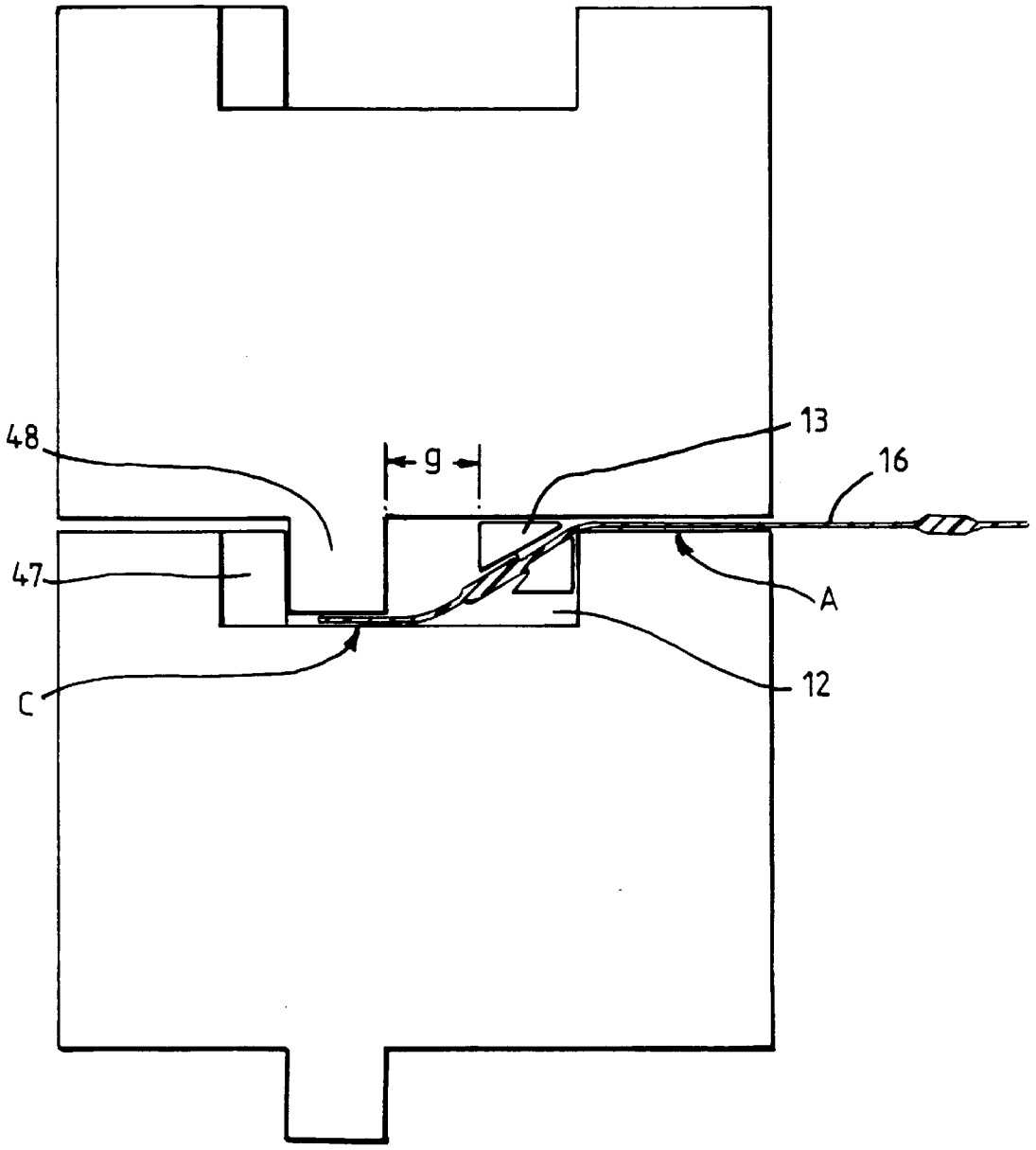
FIG. 17 is a side sectional view through two courses of superimposed blocks of the type illustrated in FIG. 15, showing retention of a geogrid between them.

FIG. 17 illustrates in schematic cross-section the construction of a wall using the block of FIG. 15, with a portion of geogrid reinforcing material 16 inserted between two courses of blocks and retained by the anchor element 13 in the cavity formed between the channel 12 and the lower face of the block above it. It will be noted that the spine 48 is significantly narrower than the channel 12, thus leaving a gap "g" between the rear face of the spine 48 and the anchor element 13. This gap permits articulation between the staggered blocks in adjacent courses, at the point of contact between the spine 48 and the protruberance 47, without the rear edge of the spine fouling the anchor element 13.

It will also be noted, in FIG. 17, that the geogrid 16 is trapped between the two courses of blocks at areas "A" and "C". These areas are disposed on either side of the centre of gravity of the block; and the depth of the spine 48 is the same as that of channel 12; so that this design maintains the vertical alignment of the blocks and stable stacking, for any thickness of geogrid, without the need to insert shims in the gaps between courses at the front of the blocks.

Although the embodiment illustrated in FIG. 17 achieves quarter-point articulation between a straight spine 48 and a profiled front channel face 46, it will be evident that the same effect could also be achieved by a corresponding profile with protruberances at the correct points on the front face of the spine bearing against a straight channel face, such as the block illustrated in FIGS. 16*a* and 16*b*, or even by designing both of these surfaces with an appropiately shaped profile. It will also be appreciated that the same mechanical effect could be achieved if the continuous spine 48 is replaced by two separate portions of spine which are located to bear against the two protuberances 47.

The blocks shown in FIGS. 15 to 17 achieve good results in wall construction, but the integral spine 48 can make it more difficult to cast and stack such blocks, and the spine is liable to damage during handling and transportation. It is, therefore, sometimes advantageous to use a block with channels both in its upper and its lower faces, in conjunction with a separate insert to provide the function of the spine. Two embodiments of this type are illustrated in FIGS. 18 and 19.

Figure 18:
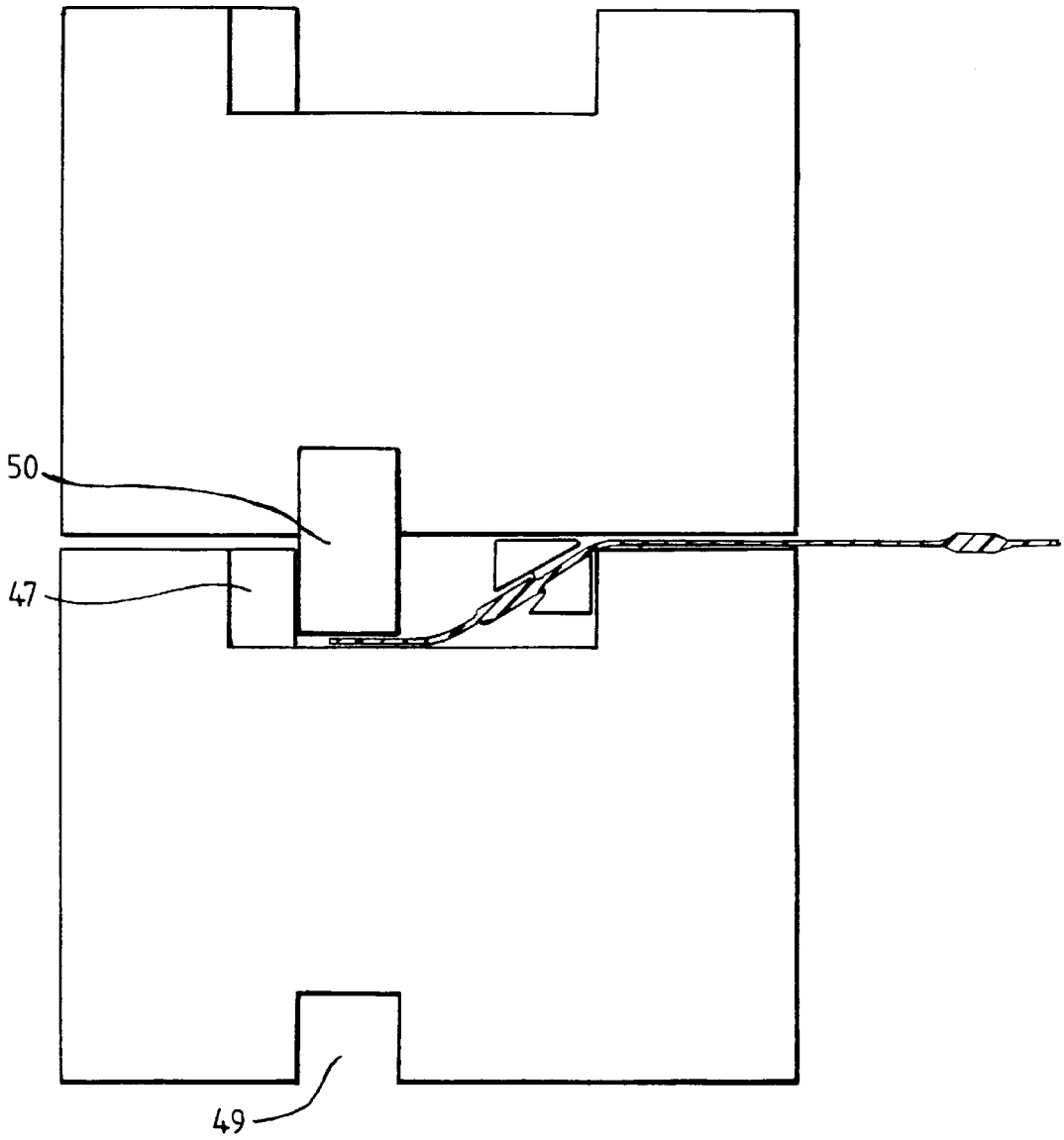
FIG. 18 is a side sectional view similar to that of FIG. 17, but with a different type of wall block which uses a separate insert in its design to achieve quarter-point articulation.

FIG. 18 shows a cross-section through two courses of wall blocks designed for use with separate spine insert 50 which mates with a slot 49 in the lower face of the block. When fitted into the slot, this insert functions exactly the same way as the integral spine 48 of the embodiments shown in FIGS. 15 to 17; and all the other features of the block in FIG. 18 are also the same, including the protruberances 47 on the front wall of the channel, and the gap between the spine and the anchor element for the geogrid.

Figure 19:
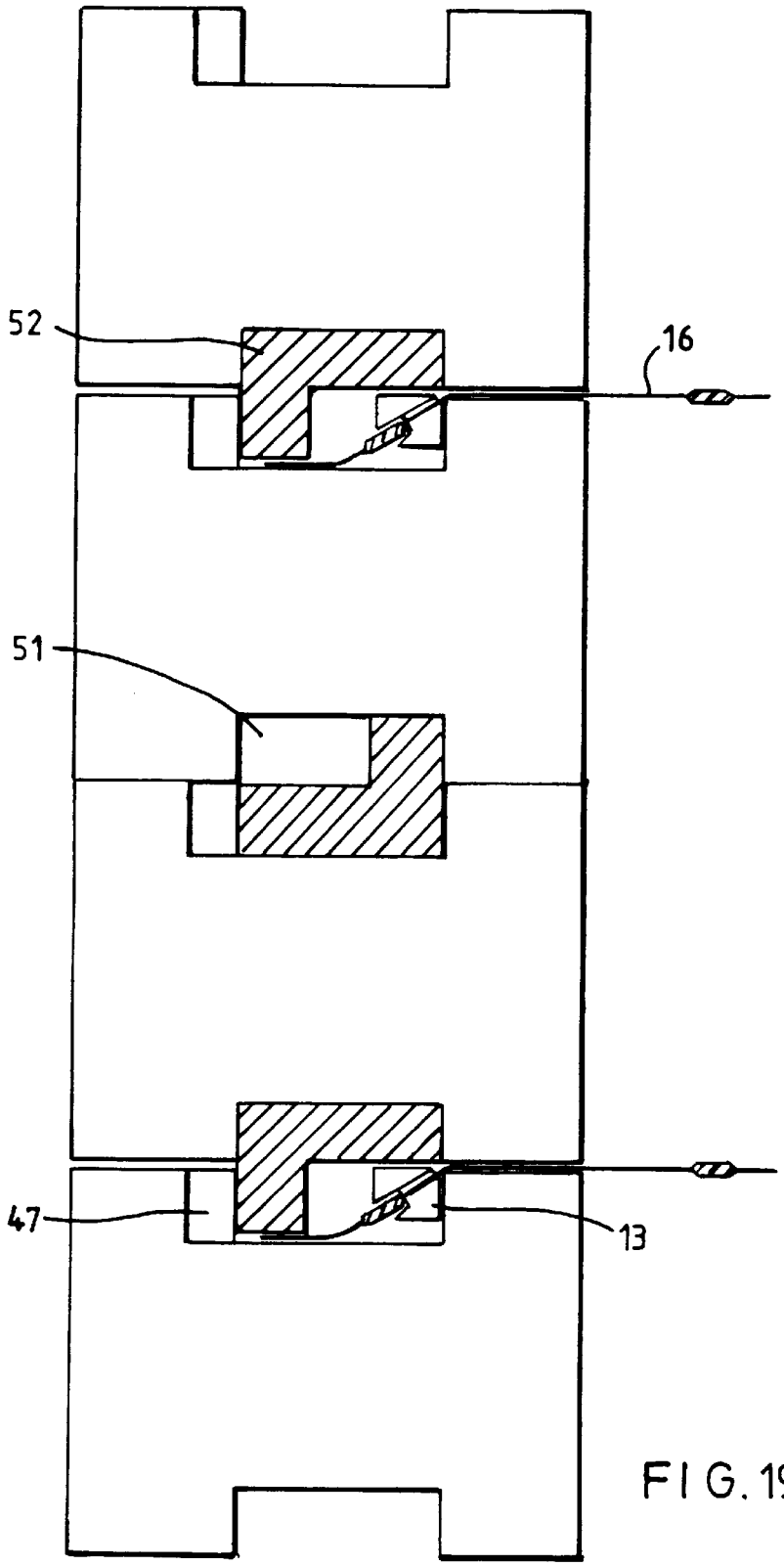
FIG. 19 is a side sectional view through four superimposed courses of blocks illustrating the use of yet another design of separate insert.

A different shape of separate insert is illustrated in the embodiment of FIG. 19, which shows a cross-section through four courses of wall blocks. This spine insert 52 has an L-shaped cross-section. In the top and bottom layers of the illustrated construction, where a geogrid is retained between the courses of blocks, the horizontal arm of the insert fits flush into the channel 51 in the lower face of the block, so that it provides a flat surface planar with said lower face to define the cavity for the anchor element 13; and the vertical arm acts in exactly the same way as the spine in FIGS. 15–18, to bear against the protruberance 47 and provide quarter-point articulation between the blocks. In other respects, the design of the blocks is the same as in FIGS. 15–18. When no geogrid is to be inserted between the courses, as in the middle layer of FIG. 19, the L-shaped insert is inverted, for ease of construction so that it does not tilt over in the cavity; and the articulation is then provided between the front face of its horizontal arm and the protruberance 47.

The separate inserts in FIGS. 18 and 19 can be made from the same material as the wall block, or from some other suitable material having the requisite mechanical properties, including various polymers and metals.

We claim:

1. A retaining wall for reinforced infill material, of the type comprising superimposed courses of modular blocks, each block having a front face, a rear face, parallel upper and lower faces, and opposed sidewalls which extend between said upper and lower faces, and having a reinforcement material extending back from the wall into the infill material with an end portion of the reinforcement material interposed between two superimposed courses of the wall and anchored to the wall by means of an anchor element which is retained in a retaining cavity between contiguous upper and lower faces of blocks in the superimposed courses, characterised by the combination that:

the blocks are provided with means permitting pivotal articulation along the courses of the blocks in the wall whilst maintaining vertical alignment between said courses;

the anchor element retaining cavity is defined by an open channel in either one of the said upper and lower faces in blocks of one course and by a substantially flat surface in the plane of the contiguous faces of the blocks in the other course, the contiguous upper and lower faces of the blocks in the superimposed courses being parallel to each other, said channel extending transversely between the sidewalls of each respective block, wherein the included angle between the face of the block in which the channel is located and the rear wall of the channel is not substantially greater than 90°;

the anchor element has a spine which is of wedge-shaped cross-section for at least part of its length, with a plurality of spaced-apart projections extending from one side of the spine and engaging through apertures in the reinforcement material, and the anchor element is retained in said retaining cavity with the thinner edge of the spine nearer the rear face of the blocks, with said projections abutting against the rear face of the channel in the blocks of one of said superimposed courses and the side of the spine not having the projections abutting against said substantially flat surface of the blocks of the other of said superimposed courses; and substantially the whole thickness of the anchor element is located within said channel.

2. A wall as claimed in claim 1, further characterised in that said means permitting pivotal articulation act through pairs of points on the upper and lower faces of the blocks, each of which points is located at substantially a quarter of the width of the block inwardly from its proximal sidewall.

3. A wall as claimed in claim 2, further characterised in that said means permitting pivotal articulation comprise pairs of bores in the upper and lower faces of said blocks extending at least partly through the blocks in a direction substantially perpendicular to said upper and lower faces, with the centre of each bore located at substantially a quarter of the width of the block inwardly from its proximal sidewall, the bores in the upper faces of the blocks in any one course being in alignment with corresponding bores in the lower faces of blocks in a course immediately above it (if any) so as to provide conjoined bores between vertically contiguous blocks in the two courses, with pivot pins retained in said conjoined bores in pivotal engagement with at least one of said vertically contiguous blocks.

4. A wall as claimed in claim 2, further characterised in that said means permitting pivotal articulation comprise projections which are located on either the upper or lower face of blocks in one course and which bear against cooperating surfaces on the opposed faces of blocks in a vertically adjacent course, with contact between said projections in the blocks of one course and said cooperating surfaces in the blocks of the other course occuring at a pair of points on each block, and wherein each of said contact points is located at substantially a quarter of the width of the block inwardly from its proximal sidewall.

5. A wall as claimed in claim 4, further characterised in that said projections are located on the front face of a spine extending down from the lower face of the blocks of one course into the channel of the retaining cavity for the anchor element in the upper face of the blocks of the other course, with said projections on said spine bearing against the front face of said channel.

6. A wall as claimed in claim 4, further characterised in that said projections are located on the front face of the channel of the retaining cavity for the anchor element in the upper face of the blocks of one course, and said projections bear against the front face of a spine extending down into said channel from the lower face of the blocks of the other course.

7. A wall as claimed in claim 1, further characterised in that said end portion of the reinforcement material interposed between two superimposed courses of the wall bridges across said retaining cavity between said courses so as to maintain vertical alignment of superimposed courses by trapping parts of the reinforcement material of similar thickness on either side of the centre of gravity of the upper blocks.

8. A wall as claimed in claim 5, further characterised in that said end portion of the reinforcement material interposed between two superimposed courses of the wall is trapped between the lower face of said spine extending down into said channel and the bottom of said channel, in front of the centre of gravity of the upper block.

9. A retaining wall as claimed in claim 1, further characterised in that:

each block has a pair of bores in each of its upper and lower faces, symmetrically disposed between said opposed sidewalls and extending at least partly through the block in a direction substantially perpendicular to said upper and lower faces, with the centres of the bores in each pair equidistant from the front face of the block and the distance between said centres being the same for the pair in the upper face as for the pair in the lower face of the block, the bores in the upper faces of the blocks in any one course being in alignment with corresponding bores in the lower faces of blocks in a course immediately above it (if any) so as to provide conjoined bores between vertically contiguous blocks in the two courses;

pivot pins are retained in said conjoined bores, in pivotal engagement with at least one of said vertically contiguous blocks, the said bores being thus shaped and positioned in said blocks so that the pivot pins in said conjoined bores provide pivotal articulation along the courses of the blocks in the wall whilst maintaining vertical alignment between said courses; and the end portion of the reinforcement material interposed between two superimposed courses of the wall bridges across said retaining cavity between said courses.

10. An anchor element for anchoring a retaining wall for reinforced infill material to a reinforcement material interposed between two superimposed courses of modular blocks in the wall and extending from the wall into the infill material, comprising a spine with a plurality of spaced-apart projections extending from one side of the spine and capable of engaging through apertures in the reinforcement material, characterised in that said spine is of wedge-shaped cross-section for at least part of its length, and in that said anchor element is thus shaped and dimensioned so that substantially the whole of its thickness will fit in a retaining cavity defined by an open channel in either one of the upper and lower faces in blocks of one course and by a substantially flat surface in the plane of the contiguous faces in the blocks of the other course whilst said projections are engaged through said apertures in the reinforcement material.

11. An anchor element as claimed in claim 10, further characterised in that said spine is interrupted along its length by at least one flexible portion between adjacent projections.

* * * * *